US008361246B2

(12) United States Patent
Ueda et al.

(10) Patent No.: US 8,361,246 B2
(45) Date of Patent: Jan. 29, 2013

(54) PEARLITE RAIL

(75) Inventors: Masaharu Ueda, Tokyo (JP); Kyohei Sonoyama, Tokyo (JP); Takuya Tanahashi, Tokyo (JP); Teruhisa Miyazaki, Tokyo (JP); Katsuya Iwano, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 40 days.

(21) Appl. No.: 13/131,804

(22) PCT Filed: Aug. 13, 2010

(86) PCT No.: PCT/JP2010/063760

§ 371 (c)(1),
(2), (4) Date: May 27, 2011

(87) PCT Pub. No.: WO2011/021582

PCT Pub. Date: Feb. 24, 2011

(65) Prior Publication Data

US 2011/0226389 A1 Sep. 22, 2011

(30) Foreign Application Priority Data

Aug. 18, 2009 (JP) ..... P2009-189508

(51) Int. Cl.
*C22C 38/02* (2006.01)
*C22C 38/04* (2006.01)

(52) U.S. Cl. ..... 148/320; 148/332; 148/333; 148/334; 148/335; 148/336; 148/581

(58) Field of Classification Search ..... 148/320, 148/332–336, 902, 581, 584, 585
See application file for complete search history.

(56) References Cited

U.S. PATENT DOCUMENTS

| | | | |
|---|---|---|---|
| 5,209,792 | A | 5/1993 | Besch et al. |
| 2004/0187981 | A1 | 9/2004 | Ueda et al. |

FOREIGN PATENT DOCUMENTS

| | | | |
|---|---|---|---|
| JP | 51-2616 | | 1/1976 |
| JP | 8-144016 | A | 6/1996 |
| JP | 8-246100 | A | 9/1996 |
| JP | 9-111352 | A | 4/1997 |
| JP | 2003-293086 | A | 10/2003 |
| JP | 2004-346424 | A | 12/2004 |
| JP | 2006-57127 | A | 3/2006 |
| RU | 2107740 | C1 | 3/1998 |
| RU | 2112051 | C1 | 5/1998 |
| RU | 2136767 | C1 | 9/1999 |
| SU | 1839687 | A3 | 12/1993 |

OTHER PUBLICATIONS

International Search Report, dated Nov. 9, 2010, issued in PCT/JP2010/063760. Murakami, Y. et al. "Quantitative Evaluation of the Effect of Surface Roughness on Fatigue Strength (Effect of Depth and Pitch of Roughness)", The Japan Society of Mechanical Engineers, vol. 63, No. 612, Aug. 25, 1997, pp. 1612-1619.
Russian Notice of Allowance dated Oct. 2, 2012 issued in Russian Patent Application No. 2011124530 (English translation is attached).

*Primary Examiner* — Deborah Yee
(74) *Attorney, Agent, or Firm* — Birch Stewart Kolasch & Birch, LLP

(57) ABSTRACT

A pearlite rail contains, by mass %, 0.65 to 1.20% of C; 0.05 to 2.00% of Si; 0.05 to 2.00% of Mn; and the balance composed of Fe and inevitable impurities, wherein at least part of the head portion and at least part of the bottom portion has a pearlite structure, and the surface hardness of a portion of the pearlite structure is in a range of Hv320 to Hv500 and a maximum surface roughness of a portion of the pearlite structure is less than or equal to 180 μm.

14 Claims, 6 Drawing Sheets

PEARLITE RAIL

TECHNICAL FIELD

The present invention relates to a pearlite rail which enhances fatigue damage resistance of the head portion and the bottom portion of the rail. In particular, the present invention relates to a pearlite rail which is used for sharp curves in domestic and freight railways overseas.

Priority is claimed based on Japanese Patent Application No. 2009-189508, filed on Aug. 18, 2009, the contents of which are incorporated herein by reference.

BACKGROUND ART

With regard to freight railways overseas, in order to achieve high efficiency in railway transportation, a carrying capacity of freight loads has been improved. In particular, in rails used for a section through which a large number of trains passes or for sharp curves, significant wear occurs on a head top portion or a head corner portion of the rail (the periphery of corner of the rail head which intensely contacts with flange portions of wheels). Therefore, there is a problem of a reduction in the service life due to an increase in the amount of wear.

In addition, similarly, in a domestic passenger rails, particularly, in the rail used for sharp curves, the wear progresses remarkably as in the freight railways overseas, so that there is a problem in that the service life is reduced due to an increase in the amount of wear.

From this background, the development of a rail with high wear resistance is required. In order to solve the problem, a rail as described in Patent Document 1 has been developed. The main characteristic of the rail is that its pearlite structure (lamellar spacing) is made finely by performing a heat treatment in order to increase the hardness of the pearlite structure.

In Patent Document 1,a technique of performing a heat treatment on a steel rail containing high-carbon steel so as to cause the metallic structure to have a sorbite structure or a fine pearlite structure. Accordingly, by achieving a high hardness of the steel rail, it is possible to provide a rail with excellent wear resistance.

However, in recent years, further carrying capacity and further high speed of trains of freight loads has been improved for the freight railways overseas and the domestic passenger rails in order to further achieve high efficiency in railway transportation. In the rail described in Patent Document 1, it becomes difficult to ensure the wear resistance of the head portion of the rail, so that there is a problem in that the service life of the rail is greatly reduced.

Here, in order to solve the problem, a steel rail with a high carbon amount has been considered. This rail has characteristics such that the wear resistance is enhanced by increasing the volume ratio of cementite in the lamellae of the pearlite structure (for example, refer to Patent Document 2).

In Patent Document 2, a rail which has a pearlite structure as its metallic structure by enhancing a carbon amount of the steel rail to a hypereutectoid region is disclosed. Accordingly, the wear resistance is enhanced by increasing the volume ratio of a cementite phase in the pearlite lamellar, so that a rail with higher service life can be provided. According to the rail described in Patent Document 2, the wear resistance of the rail is enhanced, so that an improvement of definite service life is achieved. However, in recent years, an excessive increase in the density of railway transportation has been progressed, so that the generation of fatigue damage from the head portion or the bottom portion of the rail exists. As a result, although the rail described in Patent Document 2 is used, there is a problem in that the service life of the rail is not sufficient.

Citation List

[Patent Literature]

[Patent Document 1] Japanese Unexamined Patent Application, First Publication No. S51-002616

[Patent Document 2] Japanese Unexamined Patent Application, First Publication No. H08-144016

[Patent Document 3] Japanese Unexamined Patent Application, First Publication No. H08-246100

[Patent Document 4] Japanese Unexamined Patent Application, First Publication No. H09-111352

SUMMARY OF THE INVENTION

Problems to be Solved by the Invention

From the background, for the steel rail including a pearlite structure having a high carbon component, providing a rail in which fatigue damage resistance of the head portion and the bottom portion of the rail is improved is preferable.

The invention was made with respect to the above-described problems, it is an object of the present invention to provide a pearlite rail in which fatigue damage resistance of the rail is improved for freight railways overseas and passenger rails in domestic.

Solution to Problem (1) According to an aspect of the invention, a pearlite rail including: by mass %, 0.65 to 1.20% of C; 0.05 to 2.00% of Si; 0.05 to 2.00% of Mn; and the balance composed of Fe and inevitable impurities, wherein at least part of the head portion and at least part of the bottom portion have a pearlite structure, and a surface hardness of a portion of the pearlite structure is in a range of Hv320 to Hv500 and a maximum surface roughness of a portion of the pearlite structure is less than or equal to 180 μm.

(2) In the pearlite rail described in the above (1), it is preferable that the ratio of the surface hardness to the maximum surface roughness is greater than or equal to 3.5.

(3) In the pearlite rail described in the above (1) or (2), it is preferable that in the portion of which the maximum surface roughness is measured, the number of concavities and convexities that exceed 0.30 times the maximum surface roughness with respect to an average value of roughnesses in the rail vertical direction (height direction) from the bottom portion to the head portion be less than or equal to 40 per length of 5 mm in the rail longitudinal direction of surfaces of the head portion and the bottom portion.

(4) to (14) It is preferable that the pearlite rail described in the above (1) or (2) selectively contain components (a) to (k) as follows, by mass %: (a) one or two kinds of 0.01 to 2.00% of Cr and 0.01 to 0.50% of Mo; (b) one or two kinds of 0.005 to 0.50% of V and 0.002 to 0.050% of Nb; (c) one kind of 0.01 to 1.00% of Co; (d) one kind of 0.0001 to 0.0050% of B; (e) one kind of 0.01 to 1.00% of Cu; (f) one kind of 0.01 to 1.00% of Ni; (g) 0.0050 to 0.0500% of Ti; (h) one or two kinds of 0.0005 to 0.0200% of Ca and 0.0005 to 0.0200% of Mg; (i) one kind of 0.0001 to 0.0100% of Zr; (j) one kind of 0.0100 to 1.00% of Al; and (k) one kind of 0.0060 to 0.0200% of N. (15) It is preferable that the pearlite rail described in (1) or (2) contain, by mass %: one or two kinds of 0.01 to 2.00% of Cr and 0.01 to 0.50% of Mo; one or two kinds of 0.005 to 0.50% of V and 0.002 to 0.050% of Nb; 0.01 to 1.00% of Co; 0.0001 to 0.0050% of B;

0.01 to 1.00% of Cu; 0.01 to 1.00% of Ni; 0.0050 to 0.0500% of Ti; 0.0005 to 0.0200% of Mg and 0.0005 to 0.0200% of Ca; 0.0001 to 0.2000% of Zr; 0.0040 to 1.00% of Al; and 0.0060 to 0.0200% of N.

Advantageous Effects of Invention

In the pearlite rail described in the above (1), since an amount of 0.65 to 1.20% of C, an amount of 0.05 to 2.00% of Si, and an amount of 0.05 to 2.00% of Mn is contained, it is possible to maintain the hardness (strength) of the pearlite structure is maintained and improve a fatigue damage resistance. In addition, a martensite structure which is harmful to fatigue properties is not easily generated, and a reduction in the fatigue limit stress range can be suppressed, so that it becomes possible to enhance fatigue strength.

In addition, in the pearlite rail, at least part of the head portion and at least part of the bottom portion have a pearlite structure, and the surface hardness of at least part of the head portion and at least part of the bottom portion is in a range of Hv320 to Hv500 and has a maximum surface roughness of less than or equal to 180 μm. Therefore, it becomes possible to enhance the fatigue damage resistance of the rail for the freight railways overseas and the domestic passenger rails.

In the pearlite rail described in the above (2), since the ratio of the surface hardness to the maximum surface roughness is greater than or equal to 3.5, the fatigue limit stress range is increased, so that it becomes possible to enhance the fatigue strength. Therefore, it becomes possible to further improve the fatigue damage resistance of the pearlite rail.

In the pearlite rail described in the above (3), since the number of concavities and convexities is less than or equal to 40, the fatigue limit stress range is increased, so that the fatigue strength is significantly enhanced.

In the pearlite rail described in the above (4), since one or two kinds of 0.01 to 2.00% of Cr and 0.01 to 0.50% of Mo are contained, lamellar spacing of the pearlite structure is made finely, so that the hardness (strength) of the pearlite structure is improved and generation of the martensite structure which is harmful to the fatigue properties is suppressed. As a result, it becomes possible to improve the fatigue damage resistance of the pearlite rail.

In the pearlite rail described in the above (5), since one or two kinds of 0.005 to 0.50% of V and 0.002 to 0.050% of Nb is contained, austenite grains are made finely, so that toughness of the pearlite structure is improved. In addition, since V and Nb prevent a heat-affected zone of the welding joint from softening, it becomes possible to improve the toughness of the pearlite structure and strength of welded joints.

In the pearlite rail described in the above (6), since 0.01 to 1.00% of Co is contained, the ferrite structure of the rolling contact surface is made further finely, so that the wear resistance characteristics are improved.

In the pearlite rail described in the above (7), since 0.0001 to 0.0050% of B is contained, cooling rate dependency of a pearlite transformation temperature is reduced, so that the pearlite rail is provided with a more uniform hardness distribution. As a result, it becomes possible to achieve an increase in the service life of the pearlite rail.

In the pearlite rail described in the above (8), since 0.01 to 1.00% of Cu is contained, the hardness (strength) of the pearlite structure is improved, so that generation of the martensite structure which is harmful to the fatigue properties is suppressed. As a result, it becomes possible to improve the fatigue damage resistance of the pearlite rail.

In the pearlite rail described in the above (9), since 0.01 to 1.00% of Ni is contained, the strength and toughness of the pearlite structure is improved, so that the generation of the martensite structure which is harmful to the fatigue properties is suppressed. As a result, it becomes possible to improve the fatigue damage resistance of the pearlite rail.

In the pearlite rail described in the above (10), since 0.0050 to 0.0500% of Ti is contained, austenite grains are made finely, and thus the toughness of the pearlite structure is improved. In addition, embrittlement of a welding joint portion can be prevented, so that it becomes possible to improve the toughness of the pearlite rail.

In the pearlite rail described in the above (11), since one or two kinds of 0.0005 to 0.0200% of Mg and 0.0005 to 0.0200% of Ca are contained, austenite grains are made finely, and thus the toughness of the pearlite structure is improved. As a result, it becomes possible to improve the fatigue damage resistance of the pearlite rail.

In the pearlite rail described in the above (12), since 0.0001 to 0.2000% of Zr is contained, the generation of the martensite structure or the pro-eutectoid cementite structure is suppressed in a segregation portion of the pearlite rail. Accordingly, it becomes possible to improve the fatigue damage resistance of the pearlite rail.

In the pearlite rail described in the above (13), since 0.0040 to 1.00% of Al is contained, a eutectoid transformation temperature can be moved to a high temperature side. Accordingly, the pearlite structure has a high hardness (strength), it becomes possible to improve the fatigue damage resistance.

In the pearlite rail described in the above (14), since 0.0060 to 0.0200% of N is contained, pearlite transformation from austenite grain boundaries is accelerated and a block size of pearlite is made finely. Accordingly, the toughness thereof is improved, it becomes possible to improve the toughness of the pearlite rail.

In the pearlite rail described in the above (15), by adding Cr, Mo, V, Nb, Co, B, Cu, Ni, Ti, Ca, Mg, Zr, Al, and N, it becomes possible to achieve the improvement of fatigue damage resistance, the improvement of wear resistance, the improvement of toughness, the prevention of softening of the welding heat-affected zone, and control of a cross-sectional hardness distribution of an internal portion of the head portion of the pearlite rail.

DESCRIPTION OF EMBODIMENTS

Hereinafter, a pearlite-based rail (a pearlite rail) having excellent wear resistance and fatigue damage resistance according to an embodiment of the invention will be described in detail. Here, the embodiment is not limited to the following description and it will be understood by those skilled in the art that the shapes and details thereof can be modified in various forms without departing from the spirit and scope of the embodiment. Therefore, the embodiment is not construed as being limited by the description provided later. Hereinafter, in terms of composition, mass % is simply referred to as %. In addition, as necessary, the pearlite-based rail according to this embodiment is referred to as a steel rail.

First, the inventors examined situations in which fatigue damage of steel rails in an actual track occurs. As a result, it was confirmed that fatigue damage of a head portion of the steel rail does not occur in a rolling surface which is in contact with wheels but occurs from a surface of a non-contact portion in the periphery thereof. In addition, it was confirmed that fatigue damage of a bottom portion of the steel rail occurs from a surface in the vicinity of a center portion of the bottom portion in a width direction where stress is relatively high. Therefore, it was found that the fatigue damage of the actual track occurs from the head portion and the surface of the bottom portion of a product rail.

Moreover, the inventors showed generation factors of the fatigue damage of the steel rail based on the examination results. It is known that the fatigue strength of steel is generally correlated with a tensile strength (hardness) of steel. Here, a steel rail was produced by using steel having a C amount of 0.60 to 1.30%, a Si amount of 0.05 to 2.00%, and a Mn amount of 0.05 to 2.00% and performing rail rolling and heat treatment thereon, and a fatigue test that the usage conditions of a real track was reproduced. In addition, test conditions are as follows:

(x1) Rail shape: a steel rail (67 kg/m) of 136 pounds is used.

(x2) Fatigue test

Test method: a test of three-point bending (span length of 1 m and a frequency of 5 Hz) is performed on an actual steel rail.

Load condition: stress range control (maximum-minimum, the minimum load is 10% of the maximum load) is performed.

(x3) Test posture: a load is added on a rail head portion (tensile strength is added on a bottom portion).

(x4) Number of repetition: 2 million times, the maximum stress range without fracturing is referred to as a fatigue limit stress range.

Figure 1:
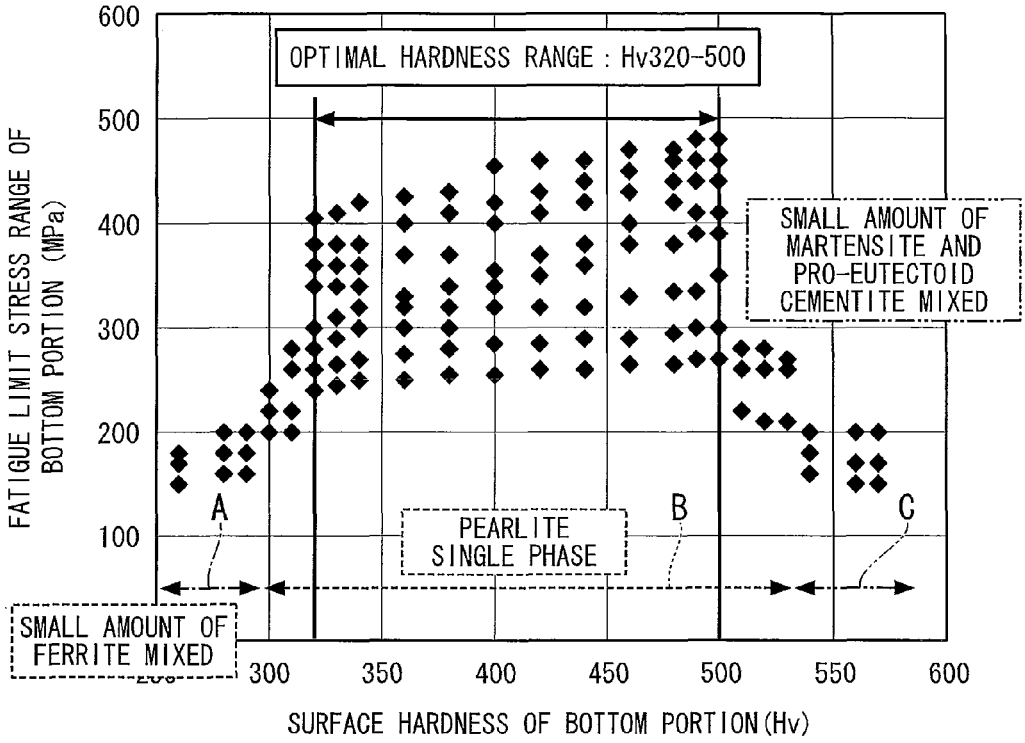
FIG. 1 is a graph showing a relationship between a hardness or a metallic structure of a surface of the bottom portion of a pearlite rail and a fatigue limit stress range as a result of a fatigue test on the pearlite rail according to an embodiment of the invention.

Results of the fatigue test of the actual steel rail in three-point bending are shown in FIG. 1. FIG. 1 is a graph showing a relationship between a hardness or a metallic structure of the surface of the bottom portion of the steel rail and a fatigue limit stress range. Here, the surface of the bottom portion of the steel rail is a sole portion 3 shown in FIG. 5. Regarding the fatigue limit stress range, as described in above (x2), when the test is performed by varying the load between the maximum stress and the minimum stress, the difference between the maximum stress and the minimum stress is the same as the stress range in the fatigue test, and particularly, as described in above (x4), the maximum stress range without fracturing is as the fatigue limit stress range.

In FIG. 1, it was confirmed that the fatigue limit stress range that determines the fatigue properties of steel are correlated with the metallic structure of steel. It was found that the steel rail in a region indicated by the arrow A of FIG. 1 (bottom portion surface hardness of Hv250 to 300) in which a small amount of ferrite structure is mixed with the pearlite structure, and the steel rail in a region indicated by the arrow C of FIG. 1 (bottom surface hardness of Hv530 to 580) in which a small amount of martensite structure and pro-eutectoid cementite structure is mixed with the pearlite structure have greatly reduced fatigue limit stress ranges and thus have greatly reduced fatigue strength.

In addition, in a region indicated by the arrow B of FIG. 1 which represents a single phase structure of pearlite (bottom surface hardness of Hv300 to 530), there is a tendency towards the fatigue limit stress range increasing with the surface hardness. However, as the bottom portion surface hardness exceeds Hv500, the fatigue limit stress range is greatly reduced. Therefore, it was found that in order to reliably secure a predetermined fatigue strength, the surface hardness needs to be confined within a predetermined range.

Moreover, the inventors verified factors that vary the fatigue limit stress ranges of steel rails having the same hardness, in order to reliably improve fatigue strength of the steel rail. As shown in FIG. 1, the fatigue limit stress ranges of pearlite structure having the same hardness vary with ranges of about 200 to 250 MPa. Here, the starting point of a steel rail that was fractured during the fatigue test was examined. As a result, it was confirmed that the starting point has concavities and convexities, and fatigue damage occurs from the concavities and convexities.

Figure 2:
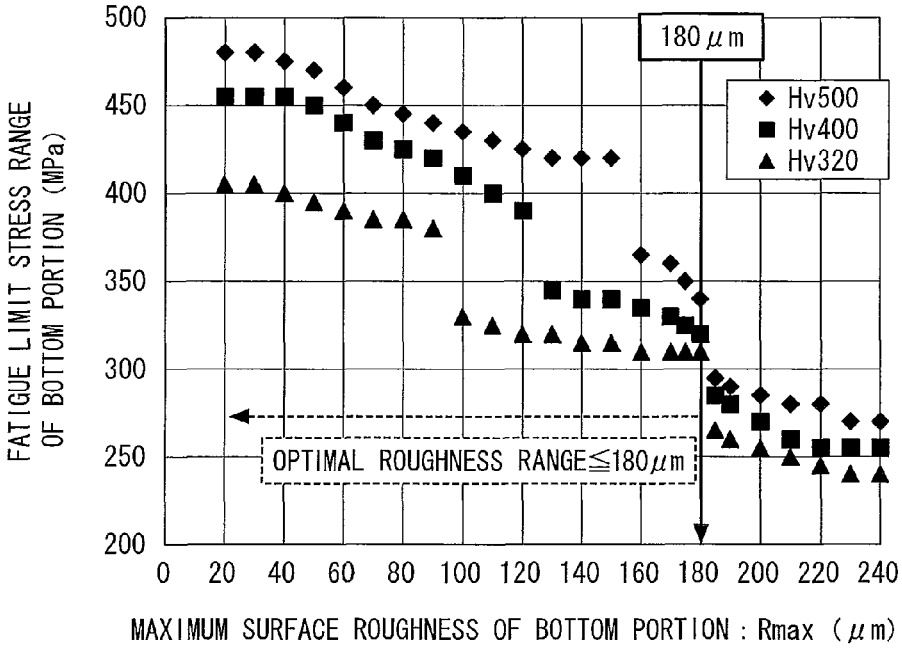
FIG. 2 is a graph showing a relationship between the maximum surface roughness Rmax of the surface of the bottom portion of the pearlite rail and the fatigue limit stress range.

Here, the inventors examined a relationship between fatigue strength of the steel rail and concavities and convexities of the surface thereof in detail. The result is shown in FIG. 2. FIG. 2 is a graph showing a relationship between the maximum surface roughness Rmax and the fatigue limit stress range by measuring roughness of the surface of a bottom portion of a steel rail having a C amount of 0.65 to 1.20%, a Si amount of 0.50%, a Mn amount of 0.80%, and a hardness of Hv320 to Hv500 using a roughness meter. Here, the maximum surface roughness is the sum of a depth of the maximum valley and a height of the maximum mountain with respect to an average value of depths or heights from the bottom portion to a head portion in the rail vertical direction (height direction) as a measurement reference length, and for details, indicates the maximum height (Rz) of a roughness curve described in JIS B 0601. In addition, when the surface roughness is measured, scale (oxide film) of the rail surface was removed by acid washing or sandblasting in advance.

The fatigue strength of steel is correlated with the maximum surface roughness Rmax, and in FIG. 2, when the maximum surface roughness Rmax is less than or equal to 180 μm, the fatigue limit stress range is significantly increased. Accordingly, it was found that the minimum fatigue strength (≧300 MPa) needed for the rail is ensured. In addition, the rail having a hardness of Hv320 further increases in the fatigue limit stress range when its maximum surface roughness Rmax is less than or equal to 90 μm, the rail having a hardness of Hv400 further increases in the fatigue limit stress range when its maximum surface roughness Rmax is less than or equal to 120 μm, and the rail having a hardness of Hv500 further increases in the fatigue limit stress range when its maximum surface roughness Rmax is less than or equal to 150 μm.

From the result, in order to improve the fatigue strength of the steel rail having high carbon component, it was newly found that the metallic structure has to be a single phase structure of pearlite, the surface hardness of the steel rail has to be confined in the range of Hv320 to Hv500, and the maximum surface roughness (Rmax) has to be confined to be less than or equal to 180 μm.

Here, when a small amount of ferrite, martensite, and pro-eutectoid cementite is mixed with the pearlite structure, the fatigue strength is not reduced significantly. However, in order to improve the fatigue strength to the maximum degree, it is preferable that the pearlite structure have the single phase structure.

Figure 3:
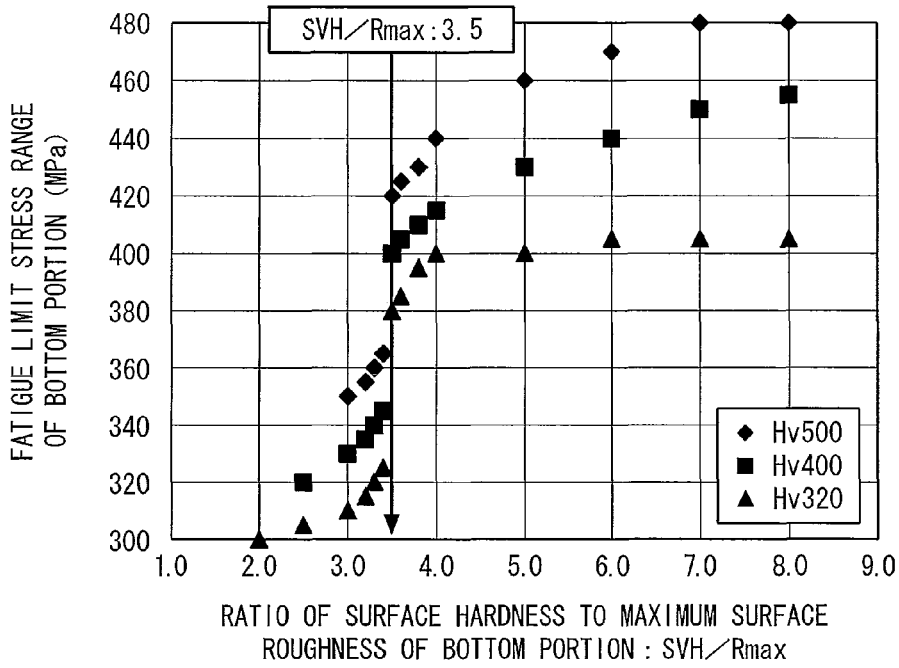
FIG. 3 is a graph showing a relationship between SVH/Rmax of the surface of the bottom portion of the pearlite rail and the fatigue limit stress range.

Moreover, the inventors examined a relationship between fatigue limit stress range, surface hardness (SVH:Surface Vickers Hardness), and maximum surface roughness Rmax of the steel rail in detail. As a result, it was found that there is a correlation between a ratio of the surface hardness (SVH) of the steel rail to the maximum surface roughness Rmax, that is, SVH/Rmax and the fatigue limit stress range. FIG. 3 is a graph showing a relationship between SVH/Rmax of the steel rail having a C amount of 0.65 to 1.20%, a Si amount of 0.50%, a Mn amount of 0.80%, and a hardness of Hv320 to Hv500 and the fatigue limit stress range thereof. It was newly known that with regard to the steel rails having any of the hardnesses Hv320, Hv400, and Hv500, the fatigue limit stress ranges of the steel rails having a value SVH/Rmax of more than or equal to 3.5 increases to 380 MPa or higher and thus the fatigue strength greatly increases.

Figure 4:
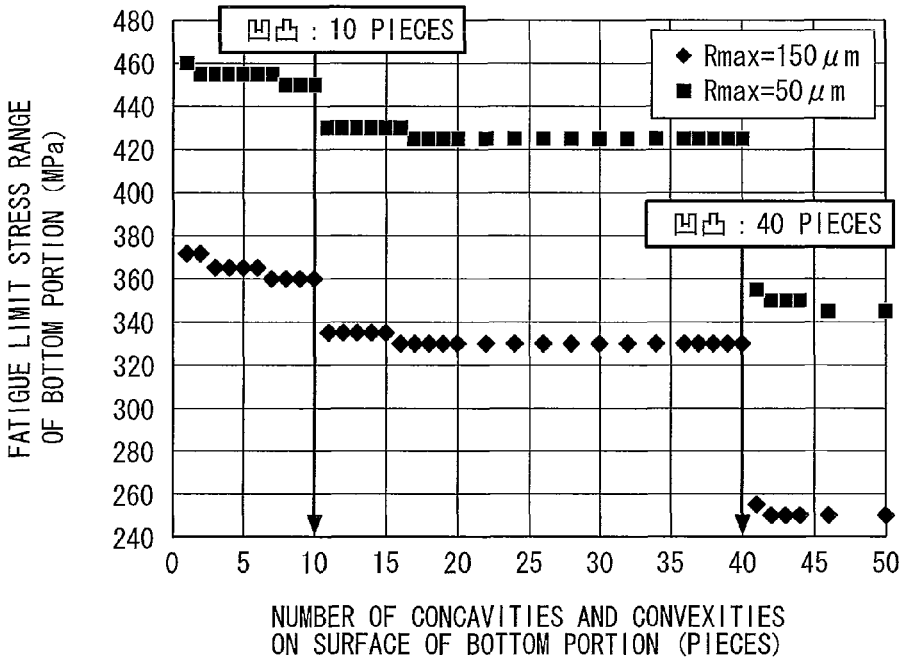
FIG. 4 is a graph showing a relationship between the number of concavities and convexities of the pearlite rail and the fatigue limit stress range.

In addition to the embodiment, the inventors examined a correlation between the roughness of the surface and the fatigue strength of the steel rail in order to improve fatigue strength of the steel rail. FIG. 4 shows a result of the fatigue test of the steel rails having a C amount of 1.00%, a Si amount of 0.50%, a Mn amount of 0.80%, and a hardness of Hv400 when the maximum surface roughnesses Rmax thereof are 150 μm and 50 μm. In order to examine a relationship between the roughness of the surface of the bottom portion and the fatigue limit stress range in detail, a correlation between the number of concavities and convexities that exceeds 0.30 times the maximum surface roughness with respect to an average value of depths or heights in the rail vertical direction (height direction) from the bottom portion to the head portion and the fatigue limit stress range. In addition, the number of concavities and convexities is counted for a length of the bottom portion of 5 mm in the rail longitudinal direction. It was found that with regard to the steel rails having any hardness and maximum surface roughnesses Rmax of 150 μm and 50 μm, by using steel rails having the number of concavities and convexities of 40 or less, and preferably, 10 or less, the fatigue limit stress range further increases, and thus the fatigue strength greatly increases.

That is, in this embodiment, by allowing the surface hardness SVH of the head portion and the bottom portion of the steel rail to be in the range of Hv320 to Hv500, and using the steel rail that has a pearlite structure with high carbon component and the maximum surface roughness Rmax of less than or equal to 180 μm, fatigue damage resistance of the pearlite-based rail used for freight railways overseas and the domestic passenger rails can be improved. In addition, by using the pearlite-based rail that has a pearlite structure with high carbon component in which a ratio SVH/Rmax of the surface hardness to the maximum surface roughness is higher than or equal to 3.5, or by using the pearlite-based rail that has a pearlite structure with high carbon component in which the number of concavities and convexities is less than or equal to 40, it is possible to increase the fatigue limit stress range and to greatly increase the fatigue strength.

In this embodiment, the results of the surface of the bottom portion of the pearlite-based rail are shown in FIGS. 1 to 4. The same results as those shown in FIGS. 1 to 4 can be obtained for the surface of the head portion of the pearlite-based rail.

In addition, the C amount, the Si amount, and the Mn amount are not limited to the values described above, and the same results can be obtained as long as the C amount is in the range of 0.65 to 1.20%, the Si amount is in the range of 0.05 to 2.00%, and the Mn amount is in the range of 0.05 to 2.00%.

Moreover, parts having the pearlite structure, parts having a surface hardness SVH in the range of Hv320 to Hv500, and parts having the maximum surface roughness Rmax of less than or equal to 180 μm may be included at least part of the head portion and at least part of the bottom portion of the pearlite-based rail.

In addition, the ratio of the surface hardness SVH to the maximum surface roughness Rmax may not necessarily be greater than or equal to 3.5, and the number of concavities and convexities may not necessarily be less than or equal to 40. However, by allowing the ratio SVH/Rmax to be greater than or equal to 3.5 and allowing the number of concavities and convexities to be less than or equal to 40, as described above, the improvement of the fatigue strength can be further achieved.

Next, the reason of limitation in this embodiment will be described in detail. Hereinafter, in terms of steel composition, mass % is simply referred to as %.

(1) Reason of Limitation of Chemical Components

The reason of limitation of the chemical components of the pearlite-based rail so that the C amount is in the range of 0.65 to 1.20%, the Si amount of 0.05 to 2.00%, and the Mn amount is in the range of 0.05 to 2.00% will be described in detail.

C accelerates pearlite transformation and thus ensures wear resistance. When the C amount in the pearlite-based rail is less than 0.65%, pro-eutectoid ferrite which is harmful to fatigue properties of the pearlite structure is more likely to occur, and moreover, it becomes difficult to maintain the hardness (strength) of the pearlite structure. As a result, the fatigue damage resistance of the rail is degraded. In addition, when the C amount in the pearlite rail exceeds 1.20%, a pro-eutectoid cementite structure which is harmful to the fatigue properties of the pearlite structure is more likely to occur. As a result, the fatigue damage resistance of the rail is degraded. Accordingly, the C amount in the pearlite-based rail is limited to 0.65 to 1.20%.

Si is an essential component as a deoxidizing agent. In addition, Si increases the harness (strength) of the pearlite structure due to solid solution strengthening of the ferrite phase in the pearlite structure, and thus improves the fatigue damage resistance of the pearlite structure. Moreover, Si suppresses a generation of a pro-eutectoid cementite structure in hypereutectoid steel and thus suppresses degradation of the fatigue properties. However, when the Si amount in the pearlite-based rail is less than 0.05%, those effects cannot be sufficiently expected. In addition, when the Si amount in the pearlite-based rail exceeds 2.00%, hardenability significantly increases, and thus a martensite structure which is harmful to the fatigue properties is more likely to occur. Accordingly, the amount of Si added to the pearlite-based rail is limited to 0.05 to 2.00%.

Mn increases hardenability and thus makes a lamellar spacing in the pearlite structure fine, thereby ensuring the hardness (strength) of the pearlite structure and enhancing the fatigue damage resistance. However, when the amount of Mn contained in the pearlite-based rail is less than 0.05%, those effects are small, and it becomes difficult to ensure the fatigue damage resistance that is needed for the rail. In addition, when the amount of Mn contained in the pearlite-based rail exceeds 2.00%, hardenability is significantly increased, and the martensite structure which is harmful to the fatigue properties is more likely to occur. Accordingly, the amount of Mn added to the pearlite-based rail is limited to 0.05 to 2.00%.

In addition, to the pearlite-based rail produced of the component composition described above, elements Cr, Mo, V, Nb, Co, B, Cu, Ni, Ti, Ca, Mg, Zr, Al, and N are added as needed for the purpose of enhancing the hardness (strength) of the pearlite structure, that is, improving the fatigue damage resistance, improving wear resistance, improving toughness, preventing a welding heat-affected zone from softening, and controlling a cross-sectional hardness distribution of the inside of the head portion of the rail.

Here, Cr and Mo increase the equilibrium transformation point of pearlite and mainly make the pearlite lamellar spacing fine thereby ensuring the hardness of the pearlite structure. V and Nb suppress growth of austenite grains by carbide and nitride generated during hot rolling and cooling thereafter. Moreover, V and Nb improve the toughness and hardness of the pearlite structure or the ferrite structure by precipitation hardening. In addition, V and Nb stably generate carbide and nitride during re-heating and thus prevent a heat-affected zone of the welding joint from softening. Co makes the lamellar structure or ferrite grain size of a rolling contact surface fine thereby increasing wear resistance of the pearlite structure. B reduces the cooling rate dependency of the pearlite transformation temperature thereby uniformizing the hardness distribution of the rail head portion. Cu solid-solubilized into ferrite in the pearlite structure or the pearlite structure thereby increasing the hardness of the pearlite structure. Ni improves the toughness and hardness of the ferrite structure or the pearlite structure and simultaneously prevents heat-affected zone of the welding joint from softening. Ti refines the structure in weld heat-affected zones and prevents the embrittlement of welded joint heat-affected zones. Ca and Mg make the austenite grains fine during rail rolling and simultaneously accelerate pearlite transformation thereby enhancing the toughness of the pearlite structure. Zr increases an equiaxial crystallization rate of a solidified structure and suppresses formation of a segregation zone of a center portion of a bloom thereby making the thickness of the pro-eutectoid cementite structure fine. Al moves a eutectoid transformation temperature to a higher temperature side and thus increases the hardness of the pearlite structure. The main purpose of adding N is to accelerate pearlite transformation as N segregates to austenite grain boundaries and make a pearlite block size fine, thereby enhancing the toughness.

The reason of the limitation of the additive amounts of such components in the pearlite-based rail will now be described in detail.

Cr increases the equilibrium transformation temperature and consequently makes the lamellar spacing of the pearlite structure fine, thereby contributing to the increase in the hardness (strength). Simultaneously, Cr strengthens a cementite phase and thus improves the hardness (strength) of the pearlite structure, thereby enhancing the fatigue damage resistance of the pearlite structure. However, when the amount of Cr contained in the pearlite-based rail is less than 0.01%, those effects are small, and the effect of enhancing the hardness of the pearlite-based rail cannot be completely exhibited. In addition, when the amount of Cr contained in the pearlite-based rail exceeds 2.00%, the hardenability is increased, and thus the martensite structure which is harmful to the fatigue properties of the pearlite structure is more likely to occur. As a result, the fatigue damage resistance of the rail is degraded. Accordingly, the amount of Cr added to the pearlite-based rail is limited to 0.01 to 2.00%.

Mo increases the equilibrium transformation temperature like Cr and consequently makes the lamellar spacing of the pearlite structure fine thereby contributing to the increase in the hardness (strength) and enhancing the fatigue damage resistance of the pearlite structure. However, when the amount of Mo contained in the pearlite-based rail is less than 0.01%, those effects are small, and the effect of enhancing the hardness of the pearlite-based rail cannot be completely exhibited. In addition, when the amount of Mo contained in the pearlite-based rail exceeds 0.50%, the transformation rate is significantly reduced, and thus the martensite structure which is harmful to the fatigue properties of the pearlite structure is more likely to occur. As a result, the fatigue damage resistance of the rail is degraded. Accordingly, the amount of Mo added to the pearlite-based rail is limited to 0.01 to 0.50%.

V precipitates as V carbide or V nitride during typical hot rolling or a heat treatment performed at a high temperature and makes austenite grains fine due to a pinning effect. Accordingly, the toughness of the pearlite structure can be improved. Moreover, V increases the hardness (strength) of the pearlite structure due to the precipitation hardening by the V carbide and V nitride generated during cooling after the hot rolling thereby enhancing the fatigue damage resistance of the pearlite structure. In addition, V generates V carbide and V nitride in a relatively high temperature range in a heat-affected zone that is re-heated in a temperature range of lower than or equal to Acl point, and thus is effective in preventing the heat-affected zone of the welding joint from softening. However, when the V amount is less than 0.005%, those effects cannot be sufficiently expected, and the improvement of the pearlite structure in the toughness and hardness (strength) is not admitted. In addition, when the V amount exceeds 0.50%, the precipitation hardening of the V carbide or V nitride excessively occurs, and thus the toughness of the pearlite structure is degraded, thereby degrading the toughness of the rail. Accordingly, the amount of V added to the pearlite-based rail is limited to 0.005 to 0.50%.

Nb, like V, makes austenite grains fine due to the pinning effect of Nb carbide or Nb nitride during the typical hot rolling or the heat treatment performed at a high temperature and thus improves the toughness of the pearlite structure. Thereby enhancing the fatigue damage resistance of the pearlite structure. In addition, Nb increases the hardness (strength) of the pearlite structure due to the precipitation hardening by the Nb carbide and Nb nitride generated during cooling after the hot rolling. In addition, Nb stably generates Nb carbide and Nb nitride from a low temperature range to a high temperature range in the heat-affected zone that is re-heated in the temperature range of lower than or equal to Acl point, and thus prevents the heat-affected zone of the welding joint from softening. However, when the amount of Nb contained in the pearlite-based rail is less than 0.002%, those effects cannot be expected, and the improvement of the pearlite structure in the toughness and hardness (strength) is not admitted. In addition, when the Nb contained in the pearlite-based rail exceeds 0.050%, the precipitation hardening of the Nb carbide or Nb nitride excessively occurs, and thus the toughness of the pearlite structure is degraded, thereby degrading the toughness of the rail. Accordingly, the amount of Nb added to the pearlite-based rail is limited to 0.002 to 0.050%.

Co solid-solubilized into the ferrite phase in the pearlite structure and makes the fine ferrite structure formed by contact with wheels at the rolling contact surface of the rail head portion further fine thereby improving the wear resistance. When the amount of Co contained in the pearlite-based rail is less than 0.01%, the fineness of the ferrite structure cannot be achieved, so that the effect of enhancing the wear resistance cannot be expected. In addition, when the amount of Co contained in the pearlite-based rail exceeds 1.00%, those effects are saturated, so that the fineness of the ferrite structure according to the additive amount cannot be achieved. In addition, economic efficiency is reduced due to the increase in costs caused by adding alloys. Accordingly, the amount of Co added to the pearlite-based rail is limited to 0.01 to 1.00%.

B forms iron carbide boride ($Fe_{23}(CB)_6$) in the austenite grain boundaries and reduces the cooling rate dependency of the pearlite transformation temperature by the effect of accelerating the pearlite transformation. Accordingly, B gives a more uniform hardness distribution from the surface to the inside of the head portion to the rail, it becomes possible to increase the service life of the rail. However, when the amount of B contained in the pearlite-based rail is less than 0.0001%, those effects are not sufficient, and the improvement of the hardness distribution of the rail head portion is not admitted. In addition, when the amount of B contained in the pearlite-based rail exceeds 0.0050%, coarse iron carbide boride is generated, resulting in a reduction in toughness. Accordingly, the amount of B added to the pearlite-based rail is limited to 0.0001 to 0.0050%.

Cu solid-solubilized into ferrite in the pearlite structure and improve the hardness (strength) of the pearlite structure due to the solid solution strengthening, thereby enhancing the fatigue damage resistance of the pearlite structure. However, when the amount of Cu contained in the pearlite-based rail is less than 0.01%, those effects cannot be expected. In addition, when the amount of Cu contained in the pearlite-based rail exceeds 1.00%, due to a significant increase in hardenability, the martensite structure which is harmful to the fatigue properties of the pearlite structure is more likely to occur. As a result, the fatigue damage resistance of the rail is degraded. Accordingly, the Cu amount in the pearlite-based rail is limited to 0.01 to 1.00%.

Ni improves the toughness of the pearlite structure and simultaneously increases the hardness (strength) due to the solid solution strengthening thereby enhancing the fatigue damage resistance of the pearlite structure. Moreover, Ni finely precipitates as an intermetallic compound $Ni_3Ti$ with Ti at the welding heat-affected zone and suppresses softening due to the precipitation hardening. In addition, Ni suppresses embrittlement of grain boundaries in copper to which Cu is added. However, when the amount of Ni contained in the pearlite-based rail is less than 0.01%, those effects are significantly small, and when the amount of Ni contained in the pearlite-based rail exceeds 1.00%, the martensite structure which is harmful to the fatigue properties is more likely to occur in the pearlite structure due to the significant improvement of hardenability. As a result, the fatigue damage resistance of the rail is degraded. Accordingly, the amount of Ni added to the pearlite-based rail is limited to 0.01 to 1.00%.

Ti precipitates as Ti carbide or Ti nitride during the typical hot rolling or the heat treatment performed at a high temperature and makes austenite grains fine due to the pinning effect, thereby enhancing the toughness of the pearlite structure. Moreover, Ti increases the hardness (strength) of the pearlite structure due to the precipitation hardening by the Ti carbide and Ti nitride generated during cooling after the hot rolling thereby enhancing the fatigue damage resistance of the pearlite structure. In addition, Ti is used that precipitated Ti carbide and Ti nitride do not dissolve during the re-heating at welding, Ti makes the structure of the heat-affected zone heated to an austenite range fine, thereby preventing embrittlement of the welding joint portion. However, when the amount of Ti contained in the pearlite-based rail is less than 0.0050%, those effects are small. In addition, when the amount of Ti contained in the pearlite-based rail exceeds 0.0500%, coarse Ti carbide and Ti nitride are generated, and fatigue damage occur from the coarse precipitate. As a result, the fatigue damage resistance of the rail is degraded. Accordingly, the amount of Ti added to the pearlite-based rail is limited to 0.0050 to 0.0500%.

Mg is bonded to O, S, or Al and the like and forms fine oxide or sulfide. As a result, Mg suppresses growth of crystal grains during re-heating for rail rolling and makes the austenite grains fine, thereby enhancing the toughness of the pearlite structure. Moreover, Mg contributes to generation of the pearlite transformation since MgS causes MnS to finely distribute and these MnS forms nucleus of ferrite or cementite in the periphery of itself. As a result, by making the block size of pearlite fine, the toughness of the pearlite structure can be improved. However, when the amount of Mg contained in the pearlite-based rail is less than 0.0005%, those effects are weak, and when the amount of Mg contained in the pearlite-based rail exceeds 0.0200%, coarse oxide of Mg is generated, and fatigue damage occurs from the coarse oxide. As a result, the fatigue damage resistance of the rail is degraded. Accordingly, the Mg amount in the pearlite-based rail is limited to 0.0005 to 0.0200%.

Ca is strongly bonded to S and forms sulfide as CaS, and moreover, Ca causes MnS to finely distribute and causes a depleted zone of Mn to form in the periphery of Mns, thereby contributing to the generation of the pearlite transformation. As a result, by making the block size of pearlite fine, the toughness of the pearlite structure can be improved. However, when the amount of Ca contained in the pearlite-based rail is less than 0.0005%, those effects are weak, and when the amount of Ca contained in the pearlite-based rail exceeds 0.0200%, coarse oxide of Ca is generated, and fatigue damage occurs from the coarse oxide. As a result, the fatigue damage resistance of the rail is degraded. Accordingly, the Ca amount in the pearlite-based rail is limited to be 0.0005 to 0.0200%.

Zr increases the equiaxial crystallization rate of the solidified structure since a $ZrO_2$ inclusion has high consistency of crystal with y-Fe and becomes a solidification nucleus of the high-carbon pearlite-based rail which is primary crystal solidification. As result, Zr suppresses formation of the segregation zone of the center portion of the bloom, thereby suppressing the generation of martensite from the rail segregation portion or the generation of the pro-eutectoid cementite structure. However, when the amount of Zr contained in the pearlite-based rail is less than 0.0001%, the number of $ZrO_2$-based inclusions is small, and Zr does not show a sufficient function as a solidification nucleus. As a result, a martensite or pro-eutectoid cementite structure is generated from the segregation portion, so that the fatigue damage resistance of the rail is degraded. In addition, when the amount of Zr contained in the pearlite-based rail exceeds 0.2000%, a large amount of coarse Zr-based inclusions is generated, and fatigue damage occurs from the coarse Zr-based inclusions as starting points, so that the fatigue damage resistance of the rail is degraded. Accordingly, the Zr amount in the pearlite-based rail is limited to be 0.0001 to 0.2000%.

Al is an essential component as a deoxidizing component. In addition, Al moves the eutectoid transformation temperature to a high temperature side and thus contributes to the increase in the hardness (strength) of the pearlite structure, thereby enhancing the fatigue damage resistance of the pearlite structure. However, when the amount of Al contained in the pearlite-based rail is less than 0.0040%, those effects are weak. In addition, when the amount of Al contained in the pearlite-based rail exceeds 1.00%, it becomes difficult to cause Al to solid-dissolve in steel, coarse alumina-based inclusions are generated, and fatigue damage occurs from the coarse precipitates. As a result, the fatigue damage resistance of the rail is degraded. Moreover, oxide is generated during welding and weldability is significantly degraded. Accordingly, the amount of Al added to the pearlite-based rail is limited to 0.0040 to 1.00%.

N precipitates at the austenite grain boundaries, accelerates the pearlite transformation from the austenite grain boundaries. Mainly,by making the block size of pearlite fine, thereby improving the toughness. In addition, N is added simultaneously with V or Al to accelerate precipitation of VN or AIN. As a result, N makes the austenite grains fine due to the pinning effect of VN or AN during the typical hot rolling or the heat treatment performed at a high temperature, thereby enhancing the toughness of the pearlite structure. However, when the amount of N contained in the pearlite-based rail is less than 0.0060%, those effects are weak. When the amount of N contained in the pearlite-based rail exceeds 0.0200%, it becomes difficult for N to solid-dissolve in steel, and bubbles are generated as starting points of the fatigue damage, so that the fatigue damage resistance of the rail is degraded. Accordingly, the amount of N contained in the pearlite-based rail is limited to 0.0060 to 0.0200%.

The pearlite-based rail having the component composition described above is produced by a melting furnace which is typically used, such as, a converter furnace or an electric furnace. In addition, blooms are made from molten steel that is dissolved in the melting furnace by ingot blooming method, ingot separation method, or continuous casting, and the pearlite-based rail is produced through hot rolling again.

(2) Reason of Limitation of Metallic Structure

The reason that the metallic structure of the surfaces of the head portion and the bottom portion of the pearlite-based rail is limited to the pearlite structure will be described.

When the ferrite structure, the pro-eutectoid cementite structure, and the martensite structure are mixed with the pearlite structure, strain is concentrated on the ferrite structure having a relatively low hardness (strength), the generation of fatigue cracks is caused. In addition, in the pro-eutectoid cementite structure and the martensite structure having relatively low toughnesses, fine brittle breakage occurs, the generation of fatigue cracks is caused. Moreover, since the head portion of the pearlite-based rail needs to ensure wear resistance, it is preferable that the head portion have the pearlite structure. Accordingly, the metallic structure of at least part of the head portion and at least part of the bottom portion is limited to the pearlite structure.

In addition, it is preferable that the metallic structure of the pearlite-based rail according to this embodiment have a single phase structure of pearlite in which the ferrite structure, the pro-eutectoid cementite structure, and the martensite structure are not mixed therewith. However, depending on a component system of the pearlite-based rail or a heat treatment manufacturing method thereof, a small amount of the pro-eutectoid ferrite structure, the pro-eutectoid cementite structure, or the martensite structure which has an area ratio of 3% or less could be mixed in the pearlite structure. Although such structures are mixed, the structures do not have a significantly adverse effect on the fatigue damage resistance or wear resistance of the rail head portion. Therefore, even through a small amount of the pro-eutectoid ferrite structure, the pro-eutectoid cementite structure, or the martensite structure of 3% or less is mixed with the pearlite-based rail, it is possible to provide a pearlite-based rail with excellent fatigue damage resistance.

In other words, 97% or higher of the metallic structure of the head portion of the pearlite-based rail according to this embodiment may be the pearlite structure. In order to sufficiently ensure the fatigue damage resistance or wear resistance, it is preferable that 98% or higher of the metallic structure of the head portion be the pearlite structure. In addition, in the section of Microstructure in Tables 1-1, 1-2, 1-3, 1-4, 2-1, 2-2, 3-1, and 3-2, steel rails (pearlite-based rails) mentioned as "Pearlite" mean those having 97% or higher of the pearlite structure.

(3) Reason of Limitation of Surface Hardness

Next, the reason that the surface hardness SVH of the pearlite structures of the rail head portion and the bottom portion of the pearlite-based rail is limited to be in the range of Hv320 to Hv500 will be described.

In this embodiment, when the surface hardness SVH of the pearlite structure is less than Hv320, the fatigue strengths of the surface of the head portion and the bottom portion of the pearlite-based rail is reduced. As a result, the fatigue damage resistance of the rail is reduced. In addition, when the surface hardness SVH of the pearlite structure exceeds Hv500, the toughness of the pearlite structure is significantly reduced, and fine brittle breakage is more likely to occur. As a result, the generation of fatigue cracks is induced. Accordingly, the surface hardness SVH of the pearlite structure is limited to be in the range of Hv320 to Hv500.

In addition, SVH (Surface Vickers Hardness) is a surface hardness of the pearlite structure of the head portion or the bottom portion of the rail according to this embodiment, and specifically, a value measured by a Vickers hardness tester at a depth of 1 mm from the rail surface. The measurement method is described as follows.

(y1) Pretreatment: after the pearlite-based rail is cut, a transverse cross-section thereof is polished.

(y2) Measurement method: SVH is measured based on JIS Z 2244.

(y3) Measurer: SVH is measured by a Vickers hardness tester (a load of 98N).

(y4) Measurement points: positions at a depth of 1 mm from the surface of the rail head portion and the bottom portion.

Figure 5:
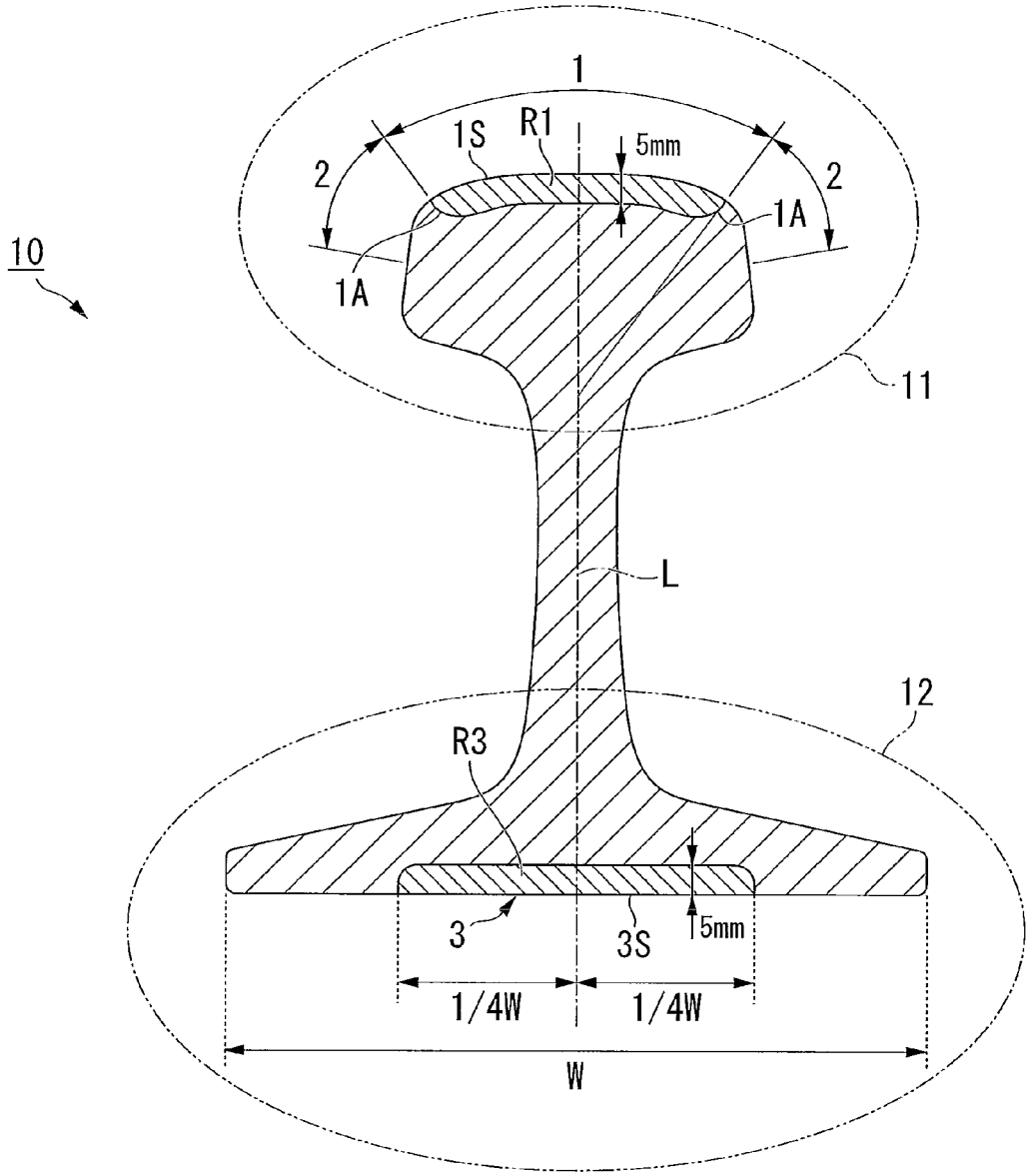
FIG. 5 is a lateral cross-sectional view showing a region that needs a pearlite structure with a hardness of Hv320 to Hv500 and a name of surface position in the cross-sectional, in the pearlite rail.

* Specific positions of the surfaces of the rail head portion and the bottom portion are conformed to indications of FIG. 5.

(y5) Measure count: it is preferable that 5 or more points be measured and an average value thereof is used as a representative value of the pearlite-based rail.

Next, the reason that ranges which need the pearlite structure having a surface hardness SVH of Hv320 to Hv500 are limited to at least part of the surfaces of the head portion and the bottom portion of the pearlite-based rail will be described.

Here, FIG. 5 illustrates names of the portions of the pearlite-based rail having excellent fatigue damage resistance at cross-sectional surface positions of the head portion and regions that need the pearlite structure having a surface hardness SVH of Hv320 to Hv500.

In the head portion 11 of the pearlite-based rail 10, a region including angular portions 1A facing side surfaces on the left and right in the width direction from the center line L indicated by a dot-dashed line in FIG. 5 is a head top portion 1, and regions including the side surfaces from the angular portions 1A on both sides of the head top portion 1 are head corner portions 2. The one head corner portion 2 is a gauge corner (G.C.) portion that is mainly in contact with wheels. In this embodiment, "the surface of the head portion of the rail" is the surface 1S of the head top portion 1.

In addition, in the bottom portion 12 of the pearlite-based rail 10, a portion including ¼ of the foot breadth (width) W from the center line L on the left and right of the width direction is a sole portion 3. In this embodiment, "the surface of the bottom portion of the rail" is the surface 3S of the sole portion 3.

In the head portion 11 of the pearlite-based rail 10, when the pearlite structure having a surface hardness SVH of Hv320 to Hv500 is disposed in at least part of the head portion 11, that is, a region R1 at a depth of 5 mm from the surface 1S of the head top portion 1 as a starting point, the fatigue damage resistance of the head portion 11 can be ensured. In addition, the depth of 5 mm is only an example, and the fatigue damage resistance of the head portion 11 of the pearlite-based rail 10 can be ensured as long as the depth is in the range of 5 mm to 15 mm.

In addition, in the bottom portion 12 of the pearlite-based rail 10, when the pearlite structure having a surface hardness SVH of Hv320 to Hv500 is disposed in at least part of the bottom portion 12, that is, in a region R3 at a depth of 5 mm from the surface 3S of the sole portion 3 as a starting point, the fatigue damage resistance of the bottom portion 12 can be ensured. In addition, the depth of 5 mm is only an example, and the fatigue damage resistance of the bottom portion 12 of the pearlite-based rail 10 can be ensured as long as the depth is in the range of 5 mm to 15 mm.

Therefore, it is preferable that the pearlite structure having a surface hardness SVH of Hv320 to Hv500 be disposed in the surface 1S of the rail head portion 1 and the surface 3S of the sole portion 3, and other portions may have metallic structures other than the pearlite structure.

In addition, although only the head top portion 1 of the head portion 11 has the pearlite structure, a region from the entire surface of the head portion 11 as a starting point may have the pearlite structure. In addition, although only the sole portion 3 of the bottom portion 12 has the pearlite structure, a region from the entire surface of the bottom portion 12 as a starting point may have the pearlite structure.

In particular, since the rail head portion wears due to the contact with wheels, it is preferable that the pearlite structure be disposed in the rail head portion including the head top portion 1 and the corner portion 2 in order to ensure wear resistance. In terms of wear resistance, it is preferable that the pearlite structure be disposed in the range of a depth of 20 mm from the surface as a starting point.

As a method of obtaining the pearlite structure having a surface hardness SVH of Hv320 to Hv500, natural cooling after rolling, and accelerated cooling of the surfaces of the rail head portion or the bottom portion at a high temperature in which the austenite region exists after the rolling or after re-heating as needed are preferable. As a method of accelerated cooling, heat treatments using the methods disclosed in Patent Documents 3 and 4 or the like may be performed to obtain predetermined structures and hardness.

(4) Reason of Limitation of Maximum Surface Roughness

Next, the reason that the maximum surface roughness Rmax of the surfaces of the head portion and the bottom portion of the pearlite-based rail 10 is limited to 180 μm or less is explained.

In this embodiment, when the maximum surface roughness (Rmax) of the surfaces of the head portion and the bottom portion of the pearlite-based rail exceeds 180 μm, stress concentration on the rail surface becomes excessive, and the generation of fatigue cracks from the rail surface is caused. Accordingly, the surface roughness (Rmax) of the surfaces of the head portion and the bottom portion of the pearlite-based rail is limited to 180 μm or less.

Moreover, although the lower limit of the maximum surface roughness (Rmax) is not particularly limited, on the premise that the rail is manufactured by hot rolling, the lower limit is about 20 μm in industrial manufacturing. In addition, regions having a maximum surface roughness in the range of 20 μm to 180 μm are, as illustrated in FIG. 5, the surface 1S of the head top portion 1 of the rail 10 and the surface 3S of the sole portion 3, and when the maximum surface roughness thereof is less than or equal to 180 μm, the fatigue damage resistance of the rail can be ensured.

It is preferable that the measurement of the maximum surface roughness (Rmax) be performed in the following method.

(z1) Pretreatment: scale on the rail surface is removed by acid washing or sandblasting.

(z2) Roughness Measurement: the maximum surface roughness (Rmax) is measured based on JIS B 0601.

(z3) Measurer: the maximum surface roughness (Rmax) is measured by a general 2D or 3D roughness measurer.

(z4) Measurement point: three arbitrary points in the surface 1S of the head top portion 1 of the rail head portion 11 and the surface 3S of the sole portion 3 of the bottom portion 12 illustrated in FIG. 5.

(z5) Measure count: it is preferable that measurement be performed on each point three times, and an average value thereof (measure count: 9) be used as a representative value of the pearlite-based rail.

(z6) Measurement length (per each measurement): a length of 5 mm from a measurement surface in the rail longitudinal direction (z7) Measurement condition: scan speed: 0.5 mm/sec In addition, the definition of the maximum surface roughness Rmax is as follows.

(z8) The maximum surface roughness Rmax: the maximum surface roughness Rmax is the sum of the depth of the maximum the depth of valley and the height of the mountain with respect to an average value of lengths from the bottom portion to the head portion in the rail vertical direction (height direction) as a base which is a measurement reference length, and "Rmax" is changed to "Rz" in JIS 2001.

(5) Reason that Ratio SVH/Rmax of Surface Hardness SVH to The Maximum Surface Roughness Rmax is Limited to 3.5 or higher.

Next, the reason that the ratio SVH/Rmax of the surface hardness (SVH) to the maximum surface hardness (Rmax) is limited to 3.5 or higher is explained.

The inventors examined the relationship among the fatigue limit stress range of the pearlite-based rail, the surface hardness SVH, and the maximum surface roughness Rmax in detail. As a result, it was found that the ratio of the surface hardness SVH to the maximum surface roughness Rmax of the pearlite-based rail, that is, SVH/Rmax is correlated with the fatigue limit stress range.

In addition, result of advancing experiment, as shown in FIG. 3, it was seen that regardless of the hardness of the surfaces of the head portion or the bottom portion of the rail, if the value of SVH/Rmax which is the ratio of the surface hardness SVH to the maximum surface roughness Rmax is higher than or equal to 3.5, the fatigue limit stress range is increased, and the fatigue strength is further improved.

Based on the experimental evidence, the ratio of the surface hardness SVH to the maximum surface roughness Rmax, that is, the value of SVH/Rmax is limited to 3.5 or higher.

(6) Reason that the number of concavities and convexities which exceed 0.30 times the maximum surface roughness with respect to the average value of roughnesses in the rail vertical direction (height direction) is limited to 40 or less per length of 5 mm Next, the reason that the number of concavities and convexities that exceed 0.30 times the maximum surface roughness with respect to the average value of roughnesses in the height direction is limited to 40 or less per length of 5 mm in the rail longitudinal length of the head portion 11 and the bottom portion 12 is explained. The number of concavities and convexities mentioned here is the number of mountains and valleys that exceed a range from the average value of roughnesses in the rail vertical direction (height direction) from the head portion 11 to the bottom portion 12, to 0.30 times the maximum surface roughness in the vertical direction (height direction).

The inventors examined in detail the roughness of the surfaces of the pearlite-based rail in order to improve the fatigue strength of the pearlite-based rail. As a result, it was found that the number of concavities and convexities that exceed 0.30 times the maximum surface roughness with respect to the average value of roughnesses in the height direction is correlated with the fatigue limit stress range. In addition, result of advancing experiment, as shown in FIG. 4, it was seen that with regard to the pearlite-based rail with any hardness and the maximum surface roughness Rmax 150 μm and 50 μm, when the number of concavities and convexities exceeds 40, the fatigue limit stress range is reduced, as a result, the fatigue strength is significantly reduced. When the number thereof is less than or equal to 40, the fatigue limit stress range is increased, as a result, the fatigue strength is significantly increased. In addition, it was seen that when the number of concavities and convexities is less than or equal to 10, the fatigue limit stress range is further increased, as a result, the fatigue strength is increased. Therefore, based on the experimental evidences, it is preferable that the number of concavities and convexities that exceed 0.30 times the maximum surface roughness with respect to the average value of roughnesses in the height direction be less than or equal to 40 per length of 5 mm in the extension direction of the head portion and the bottom portion. Moreover, the number of concavities and convexities is less than or equal to 10.

A measurement method of the number of concavities and convexities that exceed 0.30 times the maximum surface roughness is based on a measurement method of the maximum surface roughness (Rmax). The number of concavities and convexities that exceed 0.30 times the maximum surface roughness is obtained by analyzing roughness data in detail. It is preferable that the average value (measure count: 9) of concavities and convexities measured at each point three times be used as a representative value of the pearlite-based rail.

(7) Manufacturing Method of Controlling the Maximum Surface Roughness

It was confirmed that concavities and convexities occur on the rail surface when the scale of a mill roll is pushed to a material during hot rolling, and as a result, the roughness of the surface is increased.

Here, in order to reduce the surface roughness, generation of primary scale of a bloom generated inside a heating surface is reduced or removed. In addition, removing secondary scale of the bloom generated during the hot rolling becomes an effective way.

For a reduction in the primary scale of the bloom generated inside the heating furnace, a reduction in heating temperature of the heating furnace, a reduction in holding time, control of the atmosphere of the heating furnace, mechanical descaling of the bloom extracted from the heating furnace, descaling using high-pressure water or air before hot rolling are effective.

For the reduction in heating temperature of the bloom and the reduction in holding time, in point of view of ensuring rolling formability, there are great limitations on uniformly heating the bloom to the center portion. Accordingly, as practical way, control of the atmosphere of the heating furnace, mechanical descaling of the bloom extracted from the heating furnace, and descaling using high-pressure water or air before hot rolling are preferable.

For the reduction in secondary scale of the bloom generated during the hot rolling, descaling using high-pressure water or air before each hot rolling is effective. (8) Manufacturing method of controlling the number of concavities and convexities that exceed 0.30 times the maximum surface roughness The number of large concavities and convexities on the surfaces of the head portion and the bottom portion of the rail is changed depending on the mechanical descaling of the bloom for reducing the primary scale, the application of high-pressure water before the hot rolling, and the descaling using high-pressure water or air before each hot rolling for removing the secondary scale.

Here, for the purpose of uniformly peeling the scale from the surface and thus suppressing new surface concavities and convexities generated due to excessive descaling, it is preferable that the number of concavities and convexities be set to be less than or equal to a predetermined number by mechanical descaling, control or projection of measurements of spraying material, a projection speed, an injection pressure during injection of high-pressure water or air, and fluctuations in injection.

Hereinafter, each condition will be described in detail. However, the following conditions are preferable conditions and the invention is not limited to such conditions.

(A) Control of Atmosphere of Heating Furnace

With regard to the control of the atmosphere of the heating furnace, a nitrogen atmosphere which includes as little oxygen in the periphery of the bloom as possible, does not have an effect on the characteristics of a steel material, and is cheap is preferable. A volume ratio of 30% to 80% is preferable as an amount of nitrogen added to the heating furnace. When the volume ratio of nitrogen in the heating furnace is lower than 30%, the amount of primary scale generated inside the heating furnace is increased, and even when descaling is performed thereafter, the primary scale is insufficiently removed, resulting in an increase in surface roughness. In addition, even though the amount of nitrogen exceeds 80% of a volume ratio, the effect is saturated, and thus economic efficiency is reduced. Accordingly, a volume ratio of about 30% to 80% is preferable as the amount of nitrogen.

(B) Mechanical Descaling

With regard to the mechanical descaling of the bloom, it is preferable that shot blasting be performed immediately after re-heating of the bloom for the rail in which primary scale is being generated. As for conditions of the shot blasting, the method described as follows is preferable.

(a) Shot material: in case of a hard ball diameter: 0.05 to 1.0 mm, projection speed: 50 to 100 m/sec, projection density: 5 to 10 kg/m$^2$ or higher (b) Shot material: in case of polygonal fragments (grid) made of iron length dimension: 0.1 to 2.0 mm, projection speed: 50 to 100 m/sec, projection density: 5 to 10 kg/m$^2$ (c) Shot material: in case of polygonal fragments (grid) including alumina and silicon carbide length dimension: 0.1 to 2.0 mm, projection speed: 50 to 100 m/sec, projection density: 5 to 10 kg/m$^2$ In addition to the atmosphere control of the heating furnace to be in the above range and the mechanical descaling, by performing descaling using high-pressure water or air described later, the surface roughness is reduced, as a result, it becomes possible to control the maximum surface roughness (Rmax) to be less than or equal to 180 μm.

In addition, on the atmosphere control of the heating furnace basis, the mechanical descaling, and the descaling using high-pressure water or air, in the case where the ratio of the surface hardness SVH to the maximum surface roughness Rmax is to be equal to or higher than 3.5 in order to improve the fatigue damage resistance, that is, when the fatigue damage resistance is to be further increased, it is preferable that the descaling using high-pressure water or air be additionally performed.

(C) Descaling using High-pressure Water or Air

It is preferable that the descaling using high-pressure water or air be performed immediately after re-heating extraction of the bloom for the rail in which the primary scale is generated, during rough hot rolling, and during rail finish hot rolling in which secondary scale is generated. As for conditions of the descaling using high-pressure water or air, the method described as follows is preferable.

(a) High-pressure water injection pressure: 10 to 50 MPa descaling temperature range (bloom temperature for injection)

immediately after re-heating extraction and during rough hot rolling (primary scale removal): 1,250 to 1,050° C.

during finish hot rolling (secondary scale removal): 1,050 to 950° C.

(b) Air injection pressure: 0.01 to 0.10 MPa descaling temperature range (bloom temperature for injection)

immediately after re-heating extraction and during rough hot rolling (primary scale removal): 1,250 to 1,050° C.

during finish hot rolling (secondary scale removal): 1,050 to 950° C.

(D) Detailed control of mechanical descaling, and descaling using high-pressure water or air In order to uniformly peel the scale of the surfaces of the head portion of the bottom portion of the rail and suppress surface concavities and convexities newly generated during the descaling so as to cause the number of concavities and convexities that exceed 0.30 times the maximum surface roughness to be a predetermined number or smaller, it is preferable that the descaling be performed under the following conditions.

In the case of the mechanical descaling, measures to suppress the projection speed from being excessive and make dimensions (diameter or length) of the steel ball which is a shot material, polygonal fragments (grid) made of iron, and polygonal fragments (grid) including alumina and silicon carbide fine are needed.

In addition, in the case of injecting of high-pressure water or air, measures to suppress the injection pressure from being excessive and make injection holes for determining the dimensions of the spraying material fine.

In addition, with regard to the fluctuation of nozzles for the injection, it is preferable that periodical nozzle fluctuation be performed in response to the movement speed of the biller or the rail. Although the fluctuation speed is not limited, it is preferable that the fluctuation speed be controlled so that the spraying material are sprayed uniformly on portions corresponding to the surfaces of the head portion and the bottom portion of the rail.

(E) Descaling Temperature Range

It is preferable that a descaling temperature range immediately after the re-heating extraction of the bloom for the rail and during the rough hot rolling be 1,250 to 1,050° C. Since the descaling is performed immediately after re-heating (1,250 to 1,300° C.) extraction of the bloom, the upper limit of the descaling temperature is practically 1,250° C. In addition, when the descaling temperature becomes less than or equal to 1,050° C., the primary scaling is strengthened and thus cannot be easily removed. Accordingly, it is preferable that the descaling temperature range be 1,250 to 1,050° C.

It is preferable that the descaling temperature range during rail finish hot rolling be 1,050 to 950° C. Secondary scaling is generated at 1,050° C. or less, the upper limit thereof is practically 1,050° C. In addition, when the descaling temperature becomes less than or equal to 950° C., the temperature of the rail is likely to be reduced, so that the heat treatment starting temperature during a heat treatment described in Patent Documents 3 and 4 cannot be ensured. Accordingly, the hardness of the rail is reduced, resulting in a significant reduction in the fatigue damage resistance. Therefore, it is preferable that the descaling temperature range be 1,050 to 950° C.

(F) Number of descaling

In order to sufficiently remove the primary scale immediately after the extraction of the re-heated bloom and during rough hot rolling, it is preferable that descaling be performed 4 to 12 times immediately before hot rolling. When the descaling is performed less than four times, the primary scale cannot be sufficiently removed, concavities and convexities occur on the rail surface by pushing into the material side of the scale, the surface roughness is increased. That is, it is difficult for the maximum surface roughness Rmax of the rail surface to be less than or equal to 180 μm. On the other hand, when the descaling is performed more than 12 times, the roughness of the rail surface is reduced. However, the temperature of the rail itself is reduced, and the heat treatment starting temperature during the heat treatment described in Patent Documents 3 and 4 cannot be ensured. As a result, the hardness of the rail is reduced, and the fatigue damage resistance is significantly reduced. Accordingly, it is preferable that the descaling be performed 4 to 12 times immediately after the extraction of the re-heated bloom and the rough hot rolling.

In order to sufficiently remove the secondary scale during finish hot rolling, it is preferable that the descaling be performed 3 to 8 times immediately before the hot rolling. When the descaling is performed less than 3 times, the secondary scale cannot be sufficiently removed, and concavities and convexities occurs as the scale is pushed into the material, resulting in an increase in the roughness of the surface. On the other hand, when the descaling is performed more than 8 times, the roughness of the rail surface is reduced. However, the temperature of the rail itself is reduced, and the heat treatment starting temperature during the heat treatment described in Patent Documents 3 and 4 cannot be ensured. As a result, the hardness of the rail is reduced, the fatigue damage resistance is significantly reduced. Accordingly, it is preferable that the descaling be performed 3 to 8 times during the finish hot rolling.

In order to cause the ratio of the surface hardness SVH to the maximum surface roughness Rmax of the pearlite-based rail to be higher than or equal to 3.5 for further enhancing the fatigue damage resistance, it is preferable that the descaling be performed 8 to 12 times at a rough hot rolling temperature of 1,200 to 1,050° C. or 5 to 8 times at a finish hot rolling temperature of 1,050 to 950° C.

With regard to portions on which the descaling is to be performed, it is preferable that the descaling be performed at corresponding positions on the surfaces of the head portion and the bottom portion of the rail in the bloom for the rail rolling. With regard to other portions, the improvement in the fatigue damage resistance cannot be expected even though active descaling is performed, and the rail is excessively cooled, as a result, there is a concern that the material of the rail may be deteriorated.

In Tables 3-1 and 3-2, relationships between the atmosphere control of the heating furnace during hot rolling, mechanical descaling, conditions of the descaling during rough hot rolling immediately after the extraction of the reheated bloom and during descaling finish hot rolling, control of mechanical descaling using high-pressure water or air, heat treatment starting temperature, and heat treatment and characteristics of steel rails (the pearlite-based rails) A8 and A17 are shown.

By performing the atmosphere control, the mechanical descaling, and the descaling using high-pressure water or air under certain conditions, and by performing appropriate heat treatments as needed, the hardness (SVH) of the surfaces of the head portion and the bottom portion of the rail can be ensured, and moreover, the maximum surface roughness (Rmax) is reduced, and the number of concavities and convexities that exceed 0.30 times the maximum surface roughness can be less than or equal to a predetermined number. Accordingly, since the ratio of the surface hardness (SVH) to the maximum surface roughness Rmax can be increased, and the number of concavities and convexities can be reduced to be less than or equal to 40, and preferably, be less than or equal to 10, the fatigue damage resistance of the rail can be significantly improved.

EXAMPLES

Next, Examples of the invention will be explained.

Figure 6A:
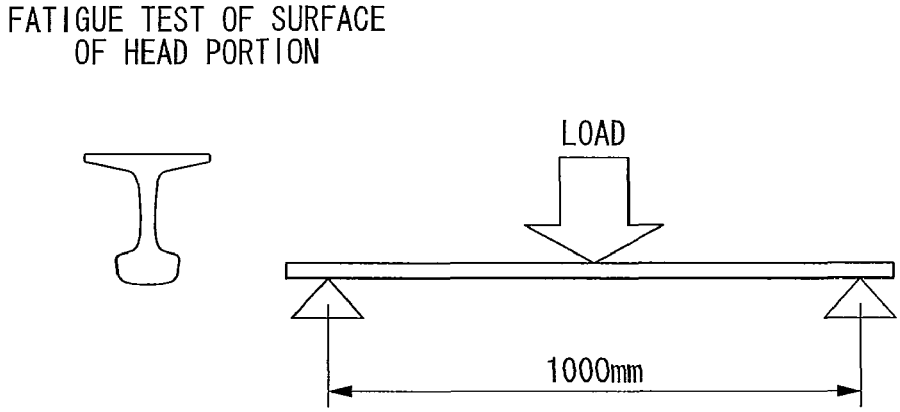
FIG. 6A is a schematic diagram showing the summary of the fatigue test on the surface of the head portion of the pearlite rail.
Figure 6B:
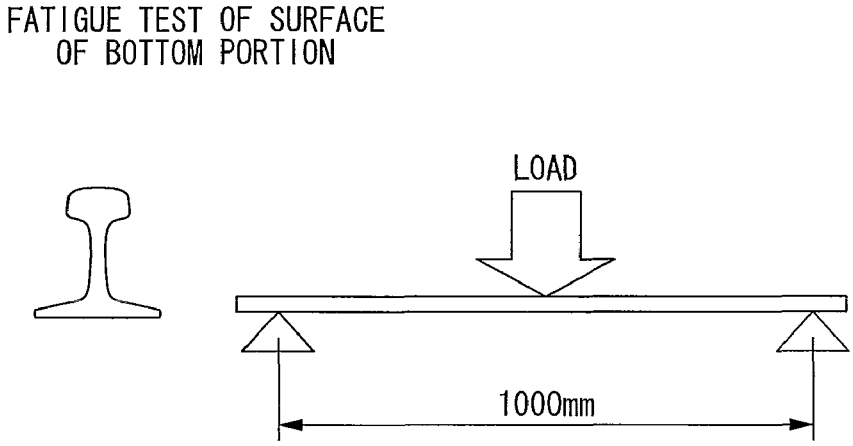
FIG. 6B is a schematic diagram showing the summary of the fatigue test on the surface of the bottom portion of the pearlite rail.

Tables 1-1 to 1-4 show chemical components and characteristics of the steel rail (pearlite-based rail) of Examples. Tables 1-1 (steel rails A1 to A19), 1-2 (steel rails A20 to A38), 1-3 (steel rails A39 to A52), and 1-4 (steel rails A53 to A65) show chemical component values, microstructures of the surfaces of the head portion and the bottom portion of the rail, surface hardness (SVH), the maximum surface roughness (Rmax), value of surface hardness (SVH)/the maximum surface roughness (Rmax), and the number of concavities and convexities (NCC) that exceed 0.30 times the maximum surface roughness, fatigue limit stress range (FLSR). Moreover, results of fatigue tests performed by methods shown in FIGS. 6A and 6B are included.

Tables 2-1 (steel rails a1 to a10) and 2-2 (steel rails a11 to a20) show chemical components and characteristics of steel rails compared to the steel rails (A1 to A65) of Examples. Tables 2-1 and 2-2 show chemical component values, microstructures of the surfaces of the head portion and the bottom portion of the rail, surface hardness (SVH), the maximum surface roughness (Rmax), surface hardness (SVH)/the maximum surface roughness (Rmax), the number of concavities and convexities (NCC) that exceed 0.30 times the maximum surface roughness, and fatigue limit stress range (FLSR). Moreover, the results of the fatigue tests performed by the methods shown in FIGS. 6A and 6B are included.

The rails shown in Tables 1-1 to 1-4, 2-1, and 2-2 were selectively subject to (A) the atmosphere control of the heating furnace, (B) the mechanical descaling, and (C) the descaling using high-pressure water or air.

The descaling using high-pressure water or air was performed 4 to 12 times at a rough hot rolling temperature of 1,250 to 1,050° C. and 3 to 8 times at a fmish hot rolling temperature of 1,050 to 950° C.

During the heat treatment after hot rolling, accelerated cooling as described in Patent Documents 3 and 4 or the like was performed as needed.

Especially, the steel rails A1 to A6 of Examples and the comparative rails a1 to a6 were subject to the descaling using high-pressure water or air 6 times at a rough hot rolling temperature of 1,250 to 1,050° C. and 4 times at a finish hot rolling temperature of 1,050 to 950° C. without the atmosphere control and the mechanical descaling, and were subjected to the accelerated cooling as described in Patent Documents 3 and 4 or the like after the hot rolling to be manufactured in predetermined conditions, and effects of the components were examined.

TABLE 1-1

| | STEEL | CHEMICAL COMPONENT (MASS %) | | | | | | | | | | | | | | | | | |
|---|---|---|---|---|---|---|---|---|---|---|---|---|---|---|---|---|---|---|---|
| | NO. | C | Si | Mn | Cr | Mo | V | Nb | Co | B | Cu | Ni | Ti | Ca | Mg | Zr | Al | N | SITE |
| EXAMPLES OF THE INVENTION | A1 | 0.85 | 0.50 | 0.80 | — | — | — | — | — | — | — | — | — | — | — | — | — | — | HEAD PORTION |
| | | | | | | | | | | | | | | | | | | | BOTTOM PORTION |
| | A2 | 1.20 | 0.50 | 0.80 | — | — | — | — | — | — | — | — | — | — | — | — | — | — | HEAD PORTION |
| | | | | | | | | | | | | | | | | | | | BOTTOM PORTION |
| | A3 | 0.90 | 0.10 | 1.10 | — | — | — | — | — | — | — | — | — | — | — | — | — | — | HEAD PORTION |
| | | | | | | | | | | | | | | | | | | | BOTTOM PORTION |
| | A4 | 0.90 | 1.95 | 1.10 | — | — | — | — | — | — | — | — | — | — | — | — | — | — | HEAD PORTION |

TABLE 1-1-continued

| | | | | | | | | | | | | | | | | | | |
|---|---|---|---|---|---|---|---|---|---|---|---|---|---|---|---|---|---|---|
| | | | | | | | | | | | | | | | | | | BOTTOM PORTION |
| A5 | 0.70 | 0.70 | 0.10 | — | — | — | — | — | — | — | — | — | — | — | — | — | — | HEAD PORTION |
| | | | | | | | | | | | | | | | | | | BOTTOM PORTION |
| A6 | 0.70 | 0.70 | 1.90 | — | — | — | — | — | — | — | — | — | — | — | — | — | — | HEAD PORTION |
| | | | | | | | | | | | | | | | | | | BOTTOM PORTION |
| A7 | 0.70 | 0.50 | 1.00 | — | — | — | — | — | — | — | — | — | — | — | — | — | — | HEAD PORTION |
| | | | | | | | | | | | | | | | | | | BOTTOM PORTION |
| A8 | 0.80 | 0.30 | 0.85 | — | — | — | — | — | — | — | — | — | — | — | — | — | — | HEAD PORTION |
| | | | | | | | | | | | | | | | | | | BOTTOM PORTION |
| A9 | 0.80 | 0.30 | 0.85 | — | — | — | — | — | — | — | — | — | — | — | — | — | — | HEAD PORTION |
| | | | | | | | | | | | | | | | | | | BOTTOM PORTION |
| A10 | 0.80 | 0.31 | 0.85 | — | — | — | — | — | — | — | — | — | — | — | — | — | — | HEAD PORTION |
| | | | | | | | | | | | | | | | | | | BOTTOM PORTION |
| A11 | 0.80 | 0.30 | 0.86 | — | — | — | — | — | — | — | — | — | — | — | — | — | — | HEAD PORTION |
| | | | | | | | | | | | | | | | | | | BOTTOM PORTION |
| A12 | 0.80 | 0.30 | 0.86 | — | — | — | — | — | — | — | — | — | — | — | — | — | — | HEAD PORTION |
| | | | | | | | | | | | | | | | | | | BOTTOM PORTION |
| A13 | 0.92 | 0.78 | 1.03 | — | — | — | — | — | — | — | — | — | — | — | — | — | — | HEAD PORTION |
| | | | | | | | | | | | | | | | | | | BOTTOM PORTION |
| A14 | 0.92 | 0.78 | 1.02 | — | — | — | — | — | — | — | — | — | — | — | — | — | — | HEAD PORTION |
| | | | | | | | | | | | | | | | | | | BOTTOM PORTION |
| A15 | 0.92 | 0.79 | 1.01 | — | — | — | — | — | — | — | — | — | — | — | — | — | — | HEAD PORTION |
| | | | | | | | | | | | | | | | | | | BOTTOM PORTION |
| A16 | 1.01 | 0.55 | 0.55 | 0.35 | — | — | — | — | — | — | — | — | — | — | — | — | — | HEAD PORTION |
| | | | | | | | | | | | | | | | | | | BOTTOM PORTION |
| A17 | 1.01 | 0.55 | 0.54 | 0.35 | — | — | — | — | — | — | — | — | — | — | — | — | — | HEAD PORTION |
| | | | | | | | | | | | | | | | | | | BOTTOM PORTION |
| A18 | 1.01 | 0.55 | 0.54 | 0.35 | — | — | — | — | — | — | — | — | — | — | — | — | — | HEAD PORTION |
| | | | | | | | | | | | | | | | | | | BOTTOM PORTION |
| A19 | 1.01 | 0.54 | 0.57 | 0.35 | — | — | — | — | — | — | — | — | — | — | — | — | — | HEAD PORTION |
| | | | | | | | | | | | | | | | | | | BOTTOM PORTION |

| STEEL NO. | MICRO STRUCTURE | SVH (Hv, 98N) | Rmax (μm) | SVH/ Rmax | NCC (PIECES) | FLSR (MPa) | NOTE |
|---|---|---|---|---|---|---|---|
| A1 | PEARLITE | 335 | 120 | 2.8 | 22 | 310 | C LOWER LIMIT |
| | PEARLITE | 340 | 110 | 3.1 | 20 | 315 | |
| A2 | PEARLITE | 430 | 160 | 2.7 | 28 | 340 | C LOWER LIMIT |
| | PEARLITE | 425 | 175 | 2.4 | 30 | 330 | |
| A3 | PEARLITE | 344 | 100 | 3.4 | 20 | 330 | Si LOWER |
| | PEARLITE | 350 | 115 | 3.0 | 24 | 325 | LIMIT |
| A4 | PEARLITE | 445 | 170 | 2.6 | 28 | 355 | Si LOWER |

TABLE 1-1-continued

| | | | | | | | |
|---|---|---|---|---|---|---|---|
| | PEARLITE | 442 | 180 | 2.5 | 30 | 350 | LIMIT |
| A5 | PEARLITE | 320 | 180 | 1.8 | 32 | 300 | Mn LOWER |
| | PEARLITE | 322 | 170 | 1.9 | 30 | 300 | LIMIT |
| A6 | PEARLITE | 455 | 160 | 2.8 | 28 | 345 | Mn UPPER |
| | PEARLITE | 465 | 170 | 2.7 | 30 | 340 | LIMIT |
| A7 | PEARLITE | 360 | 120 | 3.0 | 22 | 335 | BEST |
| | PEARLITE | 365 | 130 | 2.8 | 24 | 340 | |
| A8 | PEARLITE | 395 | 160 | 2.5 | 28 | 320 | BEST |
| | PEARLITE | 384 | 155 | 2.5 | 27 | 315 | |
| A9 | PEARLITE | 395 | 160 | 2.5 | 9 | 355 | BEST |
| | PEARLITE | 384 | 155 | 2.5 | 9 | 350 | |
| A10 | PEARLITE | 396 | 100 | 4.0 | 20 | 420 | BEST |
| | PEARLITE | 380 | 110 | 3.5 | 21 | 385 | |
| A11 | PEARLITE | 398 | 55 | 7.2 | 13 | 440 | BEST |
| | PEARLITE | 388 | 60 | 6.5 | 14 | 430 | |
| A12 | PEARLITE | 398 | 55 | 7.2 | 4 | 465 | BEST |
| | PEARLITE | 388 | 60 | 6.5 | 5 | 450 | |
| A13 | PEARLITE | 402 | 180 | 2.2 | 33 | 315 | BEST |
| | PEARLITE | 332 | 180 | 1.8 | 34 | 305 | |
| A14 | PEARLITE | 403 | 110 | 3.7 | 13 | 400 | BEST |
| | PEARLITE | 335 | 95 | 3.5 | 11 | 375 | |
| A15 | PEARLITE | 405 | 25 | 16.2 | 12 | 455 | BEST |
| | PEARLITE | 331 | 30 | 11.0 | 14 | 410 | |
| A16 | PEARLITE | 480 | 180 | 2.7 | 32 | 340 | BEST |
| | PEARLITE | 480 | 155 | 3.1 | 28 | 340 | |
| A17 | PEARLITE | 485 | 115 | 4.2 | 22 | 440 | BEST |
| | PEARLITE | 480 | 100 | 4.8 | 23 | 435 | |
| A18 | PEARLITE | 485 | 115 | 4.2 | 8 | 465 | BEST |
| | PEARLITE | 480 | 100 | 4.8 | 8 | 470 | |
| A19 | PEARLITE | 490 | 45 | 10.9 | 4 | 480 | BEST |
| | PEARLITE | 480 | 35 | 13.7 | 3 | 480 | |

TABLE 1-2

| | STEEL | CHEMICAL COMPONENT (MASS %) | | | | | | | | | | | | | | | | |
|---|---|---|---|---|---|---|---|---|---|---|---|---|---|---|---|---|---|---|
| | NO. | C | Si | Mn | Cr | Mo | V | Nb | Co | B | Cu | Ni | Ti | Ca | Mg | Zr | Al | N |
| EXAMPLES OF THE INVENTION | A20 | 1.10 | 0.80 | 0.80 | — | — | — | — | — | — | — | — | — | — | — | — | — | — |
| | A21 | 1.10 | 0.80 | 0.80 | — | — | — | — | — | — | — | — | — | — | — | — | — | — |

TABLE 1-2-continued

| | | | | | | | | | | | | | | | | | |
|---|---|---|---|---|---|---|---|---|---|---|---|---|---|---|---|---|---|
| A22 | 0.91 | 0.50 | 0.75 | — | — | — | — | — | — | — | — | — | — | — | — | — | — |
| A23 | 0.91 | 0.50 | 0.75 | — | — | — | — | — | — | — | — | — | — | — | — | — | — |
| A24 | 0.65 | 0.35 | 0.80 | — | 0.04 | — | — | — | — | — | — | — | — | — | — | — | — |
| A25 | 0.65 | 0.35 | 0.80 | — | 0.04 | — | — | — | — | — | — | — | — | — | — | — | — |
| A26 | 0.99 | 0.45 | 0.72 | — | — | 0.02 | — | — | — | — | — | — | — | — | — | — | — |
| A27 | 0.99 | 0.45 | 0.72 | — | — | 0.02 | — | — | — | — | — | — | — | — | — | — | — |
| A28 | 0.99 | 0.45 | 0.72 | — | — | 0.02 | — | — | — | — | — | — | — | — | — | — | — |
| A29 | 0.99 | 0.45 | 0.72 | — | — | 0.09 | — | — | — | — | — | — | — | — | — | — | — |
| A30 | 0.99 | 0.44 | 0.71 | 0.24 | — | 0.02 | — | — | — | — | — | — | — | — | — | — | — |
| A31 | 0.95 | 0.45 | 0.88 | — | — | — | 0.008 | — | — | — | — | — | — | — | — | — | — |
| A32 | 0.95 | 0.45 | 0.88 | — | — | — | 0.008 | — | — | — | — | — | — | — | — | — | — |
| A33 | 0.84 | 0.45 | 1.12 | — | — | — | — | 0.15 | — | — | — | — | — | — | — | — | — |
| A34 | 0.84 | 0.45 | 1.12 | — | — | — | — | 0.15 | — | — | — | — | — | — | — | — | — |
| A35 | 0.84 | 0.45 | 1.12 | — | — | — | — | 0.15 | — | — | — | — | — | — | — | — | — |
| A36 | 0.84 | 0.43 | 1.12 | 0.22 | — | — | — | 0.15 | — | — | — | — | — | — | — | — | — |
| A37 | 1.00 | 0.70 | 0.45 | — | — | — | — | — | — | 0.0025 | — | — | — | — | — | — | — |
| A38 | 1.00 | 0.70 | 0.45 | — | — | — | — | — | — | 0.0025 | — | — | — | — | — | — | — |

| STEEL NO. | SITE | MICRO STRUCTURE | SVH (Hv, 98N) | Rmax (μm) | SVH/ Rmax | NCC (PIECES) | FLSR (MPa) | NOTE |
|---|---|---|---|---|---|---|---|---|
| A20 | HEAD PORTION | PEARLITE | 430 | 140 | 3.1 | 25 | 350 | BEST |
| | BOTTOM PORTION | PEARLITE | 420 | 135 | 3.1 | 24 | 345 | |
| A21 | HEAD PORTION | PEARLITE | 425 | 80 | 5.3 | 8 | 440 | BEST |
| | BOTTOM PORTION | PEARLITE | 415 | 75 | 5.5 | 7 | 435 | |

TABLE 1-2-continued

| | | | | | | | | |
|---|---|---|---|---|---|---|---|---|
| A22 | HEAD PORTION | PEARLITE | 465 | 140 | 3.3 | 28 | 350 | Cr HIGHLY ADDED |
| | BOTTOM PORTION | PEARLITE | 380 | 130 | 2.9 | 23 | 330 | |
| A23 | HEAD PORTION | PEARLITE | 465 | 75 | 6.2 | 7 | 450 | Cr HIGHLY ADDED |
| | BOTTOM PORTION | PEARLITE | 380 | 70 | 5.4 | 8 | 425 | |
| A24 | HEAD PORTION | PEARLITE | 345 | 180 | 2.2 | 27 | 310 | Mo ADDED |
| | BOTTOM PORTION | PEARLITE | 320 | 170 | 1.9 | 28 | 300 | |
| A25 | HEAD PORTION | PEARLITE | 350 | 70 | 5.0 | 8 | 410 | Mo ADDED |
| | BOTTOM PORTION | PEARLITE | 322 | 60 | 5.4 | 8 | 405 | |
| A26 | HEAD PORTION | PEARLITE | 435 | 130 | 3.3 | 24 | 335 | V ADDED |
| | BOTTOM PORTION | PEARLITE | 425 | 140 | 3.0 | 25 | 340 | |
| A27 | HEAD PORTION | PEARLITE | 435 | 130 | 3.3 | 9 | 370 | V ADDED |
| | BOTTOM PORTION | PEARLITE | 425 | 140 | 3.0 | 9 | 360 | |
| A28 | HEAD PORTION | PEARLITE | 435 | 70 | 6.2 | 15 | 450 | V ADDED |
| | BOTTOM PORTION | PEARLITE | 425 | 60 | 7.1 | 18 | 460 | |
| A29 | HEAD PORTION | PEARLITE | 445 | 145 | 3.1 | 28 | 350 | V ADDED |
| | BOTTOM PORTION | PEARLITE | 420 | 130 | 3.2 | 22 | 340 | |
| A30 | HEAD PORTION | PEARLITE | 495 | 160 | 3.1 | 25 | 355 | Cr + V ADDED |
| | BOTTOM PORTION | PEARLITE | 490 | 170 | 2.9 | 24 | 350 | |
| A31 | HEAD PORTION | PEARLITE | 410 | 140 | 2.9 | 23 | 330 | Nb ADDED |
| | BOTTOM PORTION | PEARLITE | 350 | 120 | 2.9 | 21 | 320 | |
| A32 | HEAD PORTION | PEARLITE | 410 | 55 | 7.5 | 13 | 455 | Nb ADDED |
| | BOTTOM PORTION | PEARLITE | 350 | 40 | 8.8 | 12 | 420 | |
| A33 | HEAD PORTION | PEARLITE | 390 | 120 | 3.3 | 24 | 340 | Co ADDED |
| | BOTTOM PORTION | PEARLITE | 350 | 120 | 2.9 | 22 | 320 | |
| A34 | HEAD PORTION | PEARLITE | 390 | 40 | 9.8 | 12 | 450 | Co ADDED |
| | BOTTOM PORTION | PEARLITE | 350 | 30 | 11.7 | 11 | 430 | |
| A35 | HEAD PORTION | PEARLITE | 390 | 40 | 9.8 | 3 | 475 | Co ADDED |
| | BOTTOM PORTION | PEARLITE | 350 | 30 | 11.7 | 2 | 450 | |
| A36 | HEAD PORTION | PEARLITE | 432 | 130 | 3.3 | 23 | 340 | Cr + Co ADDED |
| | BOTTOM PORTION | PEARLITE | 370 | 120 | 3.1 | 21 | 325 | |
| A37 | HEAD PORTION | PEARLITE | 380 | 120 | 3.2 | 20 | 325 | B ADDED |
| | BOTTOM PORTION | PEARLITE | 375 | 130 | 2.9 | 21 | 320 | |
| A38 | HEAD PORTION | PEARLITE | 380 | 70 | 5.4 | 13 | 420 | B ADDED |
| | BOTTOM PORTION | PEARLITE | 375 | 65 | 5.8 | 12 | 425 | |

TABLE 1-3

| | STEEL | CHEMICAL COMPONENT (MASS %) | | | | | | | | | | | | | | | | |
|---|---|---|---|---|---|---|---|---|---|---|---|---|---|---|---|---|---|---|
| | NO. | C | Si | Mn | Cr | Mo | V | Nb | Co | B | Cu | Ni | Ti | Ca | Mg | Zr | Al | N |
| EXAMPLES OF THE INVENTION | A39 | 0.89 | 0.25 | 0.89 | — | — | — | — | — | — | 0.40 | — | — | — | — | — | — | — |
| | A40 | 0.89 | 0.25 | 0.89 | — | — | — | — | — | — | 0.40 | — | — | — | — | — | — | — |
| | A41 | 0.75 | 0.40 | 1.00 | — | — | — | — | — | — | — | 0.30 | — | — | — | — | — | — |
| | A42 | 0.75 | 0.40 | 1.00 | — | — | — | — | — | — | — | 0.30 | — | — | — | — | — | — |
| | A43 | 0.75 | 0.40 | 1.01 | — | — | — | — | — | — | 0.25 | 0.30 | — | — | — | — | — | — |
| | A44 | 0.67 | 0.45 | 0.85 | — | — | — | — | — | — | — | — | 0.0089 | — | — | — | — | — |
| | A45 | 0.67 | 0.45 | 0.85 | — | — | — | — | — | — | — | — | 0.0089 | — | — | — | — | — |
| | A46 | 0.66 | 0.48 | 0.85 | — | — | — | — | — | 0.0015 | — | — | 0.0085 | — | — | — | — | — |
| | A47 | 1.12 | 0.95 | 0.35 | — | — | — | — | — | — | — | — | — | 0.0015 | — | — | — | — |
| | A48 | 1.12 | 0.95 | 0.35 | — | — | — | — | — | — | — | — | — | 0.0015 | — | — | — | — |
| | A49 | 1.05 | 0.78 | 0.65 | — | — | — | — | — | — | — | — | — | — | 0.0025 | — | — | — |
| | A50 | 1.05 | 0.78 | 0.85 | — | — | — | — | — | — | — | — | — | — | 0.0025 | — | — | — |
| | A51 | 1.05 | 0.78 | 0.65 | — | — | — | — | — | — | — | — | — | — | 0.0025 | — | — | — |
| | A52 | 1.05 | 0.78 | 0.65 | — | — | — | — | — | — | — | — | — | — | 0.0025 | — | — | — |

| STEEL NO. | SITE | MICRO STRUCTURE | SVH (Hv, 98N) | Rmax (μm) | SVH/ Rmax | NCC (PIECES) | FLSR (MPa) | NOTE |
|---|---|---|---|---|---|---|---|---|
| A39 | HEAD PORTION | PEARLITE | 415 | 125 | 3.3 | 22 | 335 | Cu ADDED |
| | BOTTOM PORTION | PEARLITE | 420 | 130 | 3.2 | 26 | 330 | |
| A40 | HEAD PORTION | PEARLITE | 415 | 75 | 5.5 | 13 | 440 | Cu ADDED |
| | BOTTOM PORTION | PEARLITE | 420 | 70 | 6.0 | 14 | 445 | |
| A41 | HEAD PORTION | PEARLITE | 350 | 140 | 2.5 | 23 | 315 | Ni ADDED |
| | BOTTOM PORTION | PEARLITE | 345 | 125 | 2.8 | 20 | 320 | |
| A42 | HEAD PORTION | PEARLITE | 350 | 80 | 4.4 | 14 | 410 | Ni ADDED |
| | BOTTOM PORTION | PEARLITE | 345 | 70 | 4.9 | 13 | 415 | |

TABLE 1-3-continued

| | | | | | | | | |
|---|---|---|---|---|---|---|---|---|
| A43 | HEAD PORTION | PEARLITE | 385 | 125 | 3.1 | 21 | 330 | Cu + Ni ADDED |
| | BOTTOM PORTION | PEARLITE | 390 | 130 | 3.0 | 22 | 330 | |
| A44 | HEAD PORTION | PEARLITE | 345 | 125 | 2.8 | 24 | 310 | Ti ADDED |
| | BOTTOM PORTION | PEARLITE | 340 | 150 | 2.3 | 24 | 305 | |
| A45 | HEAD PORTION | PEARLITE | 345 | 45 | 7.7 | 12 | 405 | Ti ADDED |
| | BOTTOM PORTION | PEARLITE | 340 | 50 | 6.8 | 13 | 405 | |
| A46 | HEAD PORTION | PEARLITE | 350 | 125 | 2.8 | 18 | 310 | B + Ti ADDED |
| | BOTTOM PORTION | PEARLITE | 360 | 135 | 2.7 | 19 | 310 | |
| A47 | HEAD PORTION | PEARLITE | 400 | 130 | 3.1 | 22 | 335 | Ca ADDED |
| | BOTTOM PORTION | PEARLITE | 350 | 140 | 2.5 | 23 | 315 | |
| A48 | HEAD PORTION | PEARLITE | 400 | 80 | 5.0 | 14 | 430 | Ca ADDED |
| | BOTTOM PORTION | PEARLITE | 350 | 70 | 5.0 | 13 | 415 | |
| A49 | HEAD PORTION | PEARLITE | 430 | 150 | 2.9 | 26 | 330 | Mg ADDED |
| | BOTTOM PORTION | PEARLITE | 445 | 130 | 3.4 | 25 | 320 | |
| A50 | HEAD PORTION | PEARLITE | 430 | 150 | 2.9 | 8 | 355 | Mg ADDED |
| | BOTTOM PORTION | PEARLITE | 445 | 130 | 3.4 | 8 | 355 | |
| A51 | HEAD PORTION | PEARLITE | 430 | 90 | 4.8 | 18 | 430 | Mg ADDED |
| | BOTTOM PORTION | PEARLITE | 445 | 80 | 5.6 | 18 | 435 | |
| A52 | HEAD PORTION | PEARLITE | 430 | 90 | 4.8 | 17 | 485 | Mg ADDED |
| | BOTTOM PORTION | PEARLITE | 445 | 80 | 5.6 | 16 | 460 | |

TABLE 1-4

| | STEEL | CHEMICAL COMPONENT (MASS %) | | | | | | | | | | | | | | | | |
|---|---|---|---|---|---|---|---|---|---|---|---|---|---|---|---|---|---|---|
| | NO. | C | Si | Mn | Cr | Mo | V | Nb | Co | B | Cu | Ni | Ti | Ca | Mg | Zr | Al | N |
| EXAMPLES OF THE INVENTION | A53 | 1.05 | 0.79 | 0.64 | — | — | — | — | — | — | — | — | — | 0.0018 | 0.0027 | — | — | — |
| | A54 | 1.05 | 0.55 | 0.60 | 0.45 | — | — | — | — | — | — | — | — | — | 0.0020 | — | — | — |
| | A55 | 1.00 | 0.55 | 0.60 | — | — | — | — | — | — | — | — | — | — | — | 0.0012 | — | — |
| | A56 | 1.00 | 0.55 | 0.60 | — | — | — | — | — | — | — | — | — | — | — | 0.0012 | — | — |
| | A57 | 1.12 | 0.85 | 0.55 | — | — | — | — | — | — | — | — | — | — | — | — | 0.12 | — |
| | A58 | 1.12 | 0.85 | 0.55 | — | — | — | — | — | — | — | — | — | — | — | — | 0.12 | — |
| | A59 | 1.12 | 0.85 | 0.55 | — | — | — | — | — | — | — | — | — | — | — | — | 0.12 | — |

TABLE 1-4-continued

| | | | | | | | | | | | | | | | | | |
|---|---|---|---|---|---|---|---|---|---|---|---|---|---|---|---|---|---|
| A60 | 0.78 | 0.45 | 0.91 | — | — | — | — | — | — | — | — | — | — | — | — | — | 0.0085 |
| A61 | 0.78 | 0.45 | 0.91 | — | — | — | — | — | — | — | — | — | — | — | — | — | 0.0085 |
| A62 | 0.78 | 0.45 | 0.91 | — | — | — | — | — | — | — | — | — | — | — | — | — | 0.0085 |
| A63 | 0.78 | 0.45 | 0.91 | — | — | — | — | — | — | — | — | — | — | — | — | 0.0135 | 0.0081 |
| A64 | 0.78 | 0.45 | 0.91 | — | — | 0.03 | — | — | — | — | — | — | — | — | — | — | 0.0110 |
| A65 | 0.78 | 0.45 | 0.91 | — | — | 0.03 | — | — | — | — | — | — | — | — | — | — | 0.0110 |

| STEEL NO. | SITE | MICRO STRUCTURE | SVH (Hv, 98N) | Rmax (μm) | SVH/ Rmax | NCC (PIECES) | FLSR (MPa) | NOTE |
|---|---|---|---|---|---|---|---|---|
| A53 | HEAD PORTION | PEARLITE | 425 | 145 | 2.9 | 22 | 340 | Ca + Mg ADDED |
| | BOTTOM PORTION | PEARLITE | 405 | 125 | 3.2 | 20 | 330 | |
| A54 | HEAD PORTION | PEARLITE | 450 | 140 | 3.2 | 23 | 345 | Cr + Mg ADDED |
| | BOTTOM PORTION | PEARLITE | 445 | 160 | 2.8 | 30 | 335 | |
| A55 | HEAD PORTION | PEARLITE | 370 | 160 | 2.3 | 29 | 310 | Zr ADDED |
| | BOTTOM PORTION | PEARLITE | 350 | 170 | 2.1 | 24 | 300 | |
| A56 | HEAD PORTION | PEARLITE | 370 | 80 | 4.6 | 13 | 420 | Zr ADDED |
| | BOTTOM PORTION | PEARLITE | 350 | 70 | 5.0 | 14 | 410 | |
| A57 | HEAD PORTION | PEARLITE | 385 | 130 | 3.0 | 24 | 330 | Al ADDED |
| | BOTTOM PORTION | PEARLITE | 390 | 145 | 2.7 | 20 | 325 | |
| A58 | HEAD PORTION | PEARLITE | 385 | 130 | 3.0 | 6 | 360 | Al ADDED |
| | BOTTOM PORTION | PEARLITE | 390 | 145 | 2.7 | 7 | 355 | |
| A59 | HEAD PORTION | PEARLITE | 385 | 80 | 4.8 | 15 | 420 | Al ADDED |
| | BOTTOM PORTION | PEARLITE | 390 | 75 | 5.2 | 14 | 430 | |
| A60 | HEAD PORTION | PEARLITE | 345 | 140 | 2.5 | 28 | 310 | N ADDED |
| | BOTTOM PORTION | PEARLITE | 350 | 120 | 2.9 | 26 | 320 | |
| A61 | HEAD PORTION | PEARLITE | 345 | 50 | 6.9 | 12 | 430 | N ADDED |
| | BOTTOM PORTION | PEARLITE | 345 | 60 | 5.8 | 14 | 415 | |
| A62 | HEAD PORTION | PEARLITE | 345 | 50 | 6.9 | 2 | 465 | N ADDED |
| | BOTTOM PORTION | PEARLITE | 345 | 60 | 5.8 | 3 | 445 | |
| A63 | HEAD PORTION | PEARLITE | 360 | 140 | 2.6 | 24 | 310 | Al + N ADDED |
| | BOTTOM PORTION | PEARLITE | 370 | 150 | 2.5 | 23 | 310 | |
| A64 | HEAD PORTION | PEARLITE | 365 | 110 | 3.3 | 20 | 335 | V + N ADDED |
| | BOTTOM PORTION | PEARLITE | 370 | 110 | 3.4 | 20 | 335 | |
| A65 | HEAD PORTION | PEARLITE | 365 | 110 | 3.3 | 7 | 355 | V + N ADDED |

TABLE 1-4-continued

| | | | | | | |
|---|---|---|---|---|---|---|
| | BOTTOM PORTION | PEARLITE | 370 | 110 | 3.4 | 6 | 350 |

TABLE 2-1

| | STEEL | CHEMICAL COMPONENT (MASS %) | | | | | | | | | | | | | | | | | |
|---|---|---|---|---|---|---|---|---|---|---|---|---|---|---|---|---|---|---|---|
| | NO. | C | Si | Mn | Cr | Mo | V | Nb | Co | B | Cu | Ni | Ti | Ca | Mg | Zr | Al | N | SITE |
| COMPARATIVE EXAMPLE | a1 | 0.60 | 0.50 | 0.80 | — | — | — | — | — | — | — | — | — | — | — | — | — | — | HEAD PORTION |
| | | | | | | | | | | | | | | | | | | | BOTTOM PORTION |
| | a2 | 1.25 | 0.35 | 0.80 | — | — | — | — | — | — | — | — | — | — | — | — | — | — | HEAD PORTION |
| | | | | | | | | | | | | | | | | | | | BOTTOM PORTION |
| | a3 | 0.90 | 0.02 | 1.10 | — | — | — | — | — | — | — | — | — | — | — | — | — | — | HEAD PORTION |
| | | | | | | | | | | | | | | | | | | | BOTTOM PORTION |
| | a4 | 0.90 | 2.30 | 1.10 | — | — | — | — | — | — | — | — | — | — | — | — | — | — | HEAD PORTION |
| | | | | | | | | | | | | | | | | | | | BOTTOM PORTION |
| | a5 | 0.70 | 0.70 | 0.03 | — | — | — | — | — | — | — | — | — | — | — | — | — | — | HEAD PORTION |
| | | | | | | | | | | | | | | | | | | | BOTTOM PORTION |
| | a6 | 0.70 | 0.70 | 2.50 | — | — | — | — | — | — | — | — | — | — | — | — | — | — | HEAD PORTION |
| | | | | | | | | | | | | | | | | | | | BOTTOM PORTION |
| | a7 | 0.80 | 0.31 | 0.85 | — | — | — | — | — | — | — | — | — | — | — | — | — | — | HEAD PORTION |
| | | | | | | | | | | | | | | | | | | | BOTTOM PORTION |
| | a8 | 0.92 | 0.78 | 1.03 | — | — | — | — | — | | — | — | — | — | — | — | — | — | HEAD PORTION |
| | | | | | | | | | | | | | | | | | | | BOTTOM PORTION |
| | a9 | 1.01 | 0.55 | 0.54 | 0.35 | — | — | — | — | — | — | — | — | — | — | — | — | — | HEAD PORTION |
| | | | | | | | | | | | | | | | | | | | BOTTOM PORTION |
| | a10 | 0.99 | 0.44 | 0.71 | 0.24 | — | 0.02 | — | — | — | — | — | — | — | — | — | — | — | HEAD PORTION |
| | | | | | | | | | | | | | | | | | | | BOTTOM PORTION |

| STEEL NO. | MICRO STRUCTURE | SVH (Hv, 98N) | Rmax (μm) | SVH/ Rmax | NCC (PIECES) | FLSR (MPa) | NOTE |
|---|---|---|---|---|---|---|---|
| a1 | PEARLITE + FERRITE | 260 | 120 | 2.2 | 23 | 180 | DEVIATED FROM C |
| | PEARLITE + FERRITE | 260 | 110 | 2.4 | 21 | 185 | LOWER LIMIT |
| a2 | PEARLITE + PRO-EUTECTOID CEMENTITE | 540 | 160 | 3.4 | 25 | 190 | DEVIATED FROM C UPPER LIMIT |
| | PEARLITE + PRO-EUTECTOID CEMENTITE | 540 | 175 | 3.1 | 30 | 185 | |
| a3 | PEARLITE | 300 | 100 | 3.0 | 20 | 250 | DEVIATED FROM Si |
| | PEARLITE | 310 | 115 | 2.7 | 20 | 240 | LOWER LIMIT |
| a4 | PEARLITE + MARTENSITE | 570 | 170 | 3.4 | 27 | 150 | DEVIATED FROM Si |
| | PEARLITE + MARTENSITE | 580 | 180 | 3.1 | 28 | 150 | UPPER LIMIT |
| a5 | PEARLITE | 280 | 180 | 1.6 | 27 | 230 | DEVIATED FROM Mn |

TABLE 2-1-continued

| | | | | | | | |
|---|---|---|---|---|---|---|---|
| | PEARLITE | 270 | 170 | 1.6 | 27 | 235 | LOWER LIMIT |
| a6 | PEARLITE + MARTENSITE | 550 | 160 | 3.4 | 25 | 170 | DEVIATED FROM Mn |
| | PEARLITE + MARTENSITE | 560 | 170 | 3.3 | 24 | 165 | UPPER LIMIT |
| a7 | PEARLITE | 300 | 100 | 3.0 | 18 | 230 | DEVIATED FROM |
| | PEARLITE | 310 | 110 | 2.8 | 19 | 235 | HARDNESS LOWER LIMIT |
| a8 | PEARLITE | 402 | 180 | 2.2 | 28 | 315 | DEVIATED FROM |
| | PEARLITE | 300 | 180 | 1.7 | 28 | 270 | HARDNESS LOWER LIMIT |
| a9 | PEARLITE | 525 | 180 | 2.9 | 25 | 260 | DEVIATED FROM |
| | PEARLITE | 430 | 155 | 2.8 | 24 | 335 | HARDNESS UPPER LIMIT |
| a10 | PEARLITE | 520 | 160 | 3.3 | 24 | 250 | DEVIATED FROM |
| | PEARLITE | 515 | 170 | 3.0 | 25 | 245 | HARDNESS UPPER LIMIT |

TABLE 2-2

| | STEEL | CHEMICAL COMPONENT (MASS %) | | | | | | | | | | | | | | | | |
|---|---|---|---|---|---|---|---|---|---|---|---|---|---|---|---|---|---|---|
| | NO. | C | Si | Mn | Cr | Mo | V | Nb | Co | B | Cu | Ni | Ti | Ca | Mg | Zr | Al | N |
| COMPARATIVE EXAMPLE | a11 | 0.70 | 0.70 | 0.10 | — | — | — | — | — | — | — | — | — | — | — | — | — | — |
| | a12 | 0.65 | 0.35 | 0.80 | — | 0.04 | — | — | — | — | — | — | — | — | — | — | — | — |
| | a13 | 1.10 | 0.80 | 0.80 | — | — | — | — | — | — | — | — | — | — | — | — | — | — |
| | a14 | 0.92 | 0.78 | 1.03 | — | — | — | — | — | — | — | — | — | — | — | — | — | — |
| | a15 | 1.01 | 0.55 | 0.55 | 0.35 | — | — | — | — | — | — | — | — | — | — | — | — | — |
| | a16 | 1.12 | 0.95 | 0.35 | — | — | — | — | — | — | — | — | — | 0.0015 | — | — | — | — |
| | a17 | 0.78 | 0.45 | 0.91 | — | — | — | — | — | — | — | — | — | — | — | — | — | 0.0085 |
| | a18 | 0.99 | 0.45 | 0.72 | — | — | 0.02 | — | — | | — | — | — | — | — | — | — | — |
| | a19 | 0.67 | 0.45 | 0.85 | — | — | — | — | — | — | — | — | 0.0089 | — | — | — | — | — |
| | a20 | 0.84 | 0.45 | 1.12 | — | — | — | — | 0.15 | — | — | — | — | — | — | — | — | — |

TABLE 2-2-continued

| STEEL NO. | SITE | MICRO STRUCTURE | SVH (Hv, 98N) | Rmax (μm) | SVH/ Rmax | NCC (PIECES) | FLSR (MPa) | NOTE |
|---|---|---|---|---|---|---|---|---|
| a11 | HEAD PORTION | PEARLITE | 285 | 180 | 1.6 | 26 | 180 | DEVIATED FROM HARDNESS LOWER LIMIT |
| | BOTTOM PORTION | PEARLITE | 290 | 170 | 1.7 | 24 | 185 | |
| a12 | HEAD PORTION | PEARLITE | 345 | 160 | 2.2 | 23 | 310 | DEVIATED FROM HARDNESS LOWER LIMIT |
| | BOTTOM PORTION | PEARLITE | 270 | 170 | 1.6 | 23 | 170 | |
| a13 | HEAD PORTION | PEARLITE | 300 | 140 | 2.1 | 24 | 250 | DEVIATED FROM HARDNESS LOWER LIMIT |
| | BOTTOM PORTION | PEARLITE | 420 | 135 | 3.1 | 23 | 345 | |
| a14 | HEAD PORTION | PEARLITE | 402 | 250 | 1.6 | 45 | 250 | DEVIATED FROM ROUGHNESS |
| | BOTTOM PORTION | PEARLITE | 332 | 230 | 1.4 | 42 | 230 | |
| a15 | HEAD PORTION | PEARLITE | 480 | 240 | 2.0 | 43 | 260 | DEVIATED FROM ROUGHNESS |
| | BOTTOM PORTION | PEARLITE | 420 | 155 | 2.7 | 24 | 330 | |
| a16 | HEAD PORTION | PEARLITE | 400 | 130 | 3.1 | 23 | 335 | DEVIATED FROM ROUGHNESS |
| | BOTTOM PORTION | PEARLITE | 350 | 250 | 1.4 | 44 | 220 | |
| a17 | HEAD PORTION | PEARLITE | 290 | 240 | 1.2 | 43 | 235 | DEVIATED FROM HARDNESS + ROUGHNESS |
| | BOTTOM PORTION | PEARLITE | 300 | 220 | 1.4 | 42 | 240 | |
| a18 | HEAD PORTION | PEARLITE | 435 | 130 | 3.3 | 22 | 355 | DEVIATED FROM HARDNESS + ROUGHNESS |
| | BOTTOM PORTION | PEARLITE | 300 | 190 | 1.6 | 28 | 255 | |
| a19 | HEAD PORTION | PEARLITE | 300 | 190 | 1.6 | 27 | 240 | HEAD PORTION: DEVIATED FROM HARDNESS + ROUGHNESS |
| | BOTTOM PORTION | PEARLITE | 340 | 150 | 2.3 | 24 | 305 | |
| a20 | HEAD PORTION | PEARLITE | 390 | 120 | 3.3 | 23 | 340 | BOTTOM PORTION: DEVIATED FROM HARDNESS + ROUGHNESS |
| | BOTTOM PORTION | PEARLITE | 300 | 185 | 1.6 | 27 | 270 | |

TABLE 3-1

| STEEL NO. | SITE | ATMOS-PHERE CONTROL OF HEATING FURNACE | ME-CHANICAL DESCALING | DESCALING DURING ROUGH ROLLING RIGHT AFTER RE-HEATING EXTRACTION | | DESCALING DURING FINISH ROLLING | | HIGH-PRESSURE WATER, AIR, AND MECHANICAL DESCALING CONTROL |
|---|---|---|---|---|---|---|---|---|
| | | | | TEMPERA-TURE (° C.) | COUNT (TIMES) | TEMPERA-TURE (° C.) | COUNT (TIMES) | |
| A8 | HEAD PORTION | NO | NO | 1250~1050 | 4 | 1050~950 | 4 | NO |
| | BOTTOM PORTION | | | | | | | |
| | HEAD PORTION | NO | NO | 1250~1050 | 6 | 1050~950 | 4 | NO |
| | BOTTOM PORTION | | | | | | | |
| | HEAD PORTION | NO | NO | 1250~1050 | 6 | 1050~950 | 4 | YES |
| | BOTTOM PORTION | | | | | | | |
| | HEAD | NO | NO | 1250~1050 | 4 | 1050~950 | 4 | NO |

TABLE 3-1-continued

| | | | | | | | | |
|---|---|---|---|---|---|---|---|---|
| | PORTION BOTTOM PORTION | | | | | | | |
| | HEAD PORTION BOTTOM PORTION | NO | NO | 1250~1050 | 6 | 1050~950 | 4 | NO |
| | HEAD PORTION BOTTOM PORTION | NO | NO | 1250~1050 | 6 | 1050~950 | 4 | YES |
| | HEAD PORTION BOTTOM PORTION | NO | YES (HARD BALL) | 1250~1050 | 6 | 1050~950 | 4 | NO |
| | HEAD PORTION BOTTOM PORTION | YES (NITROGEN 30%) | NO | 1250~1050 | 6 | 1050~950 | 4 | NO |
| | HEAD PORTION BOTTOM PORTION | NO | NO | 1250~1050 | 8 | 1050~950 | 4 | NO |
| | HEAD PORTION BOTTOM PORTION | NO | NO | 1250~1050 | 12 | 1050~950 | 4 | YES |
| | HEAD PORTION BOTTOM PORTION | NO | NO | 1250~1050 | 12 | 1050~950 | 4 | NO |
| | HEAD PORTION BOTTOM PORTION | NO | YES (ALUMINA GRID) | 1250~1050 | 12 | 1050~950 | 4 | NO |
| | HEAD PORTION BOTTOM PORTION | YES (NITROGEN 30%) | NO | 1250~1050 | 12 | 1050~950 | 4 | NO |
| | HEAD PORTION BOTTOM PORTION | YES (NITROGEN 30%) | YES (HARD BALL) | 1250~1050 | 12 | 1050~950 | 4 | NO |
| | HEAD PORTION BOTTOM PORTION | YES (NITROGEN 30%) | YES (HARD BALL) | 1250~1050 | 12 | 1050~950 | 4 | YES |
| | HEAD PORTION BOTTOM PORTION | NO | NO | 1250~1050 | 14 | 1050~950 | 4 | NO |
| | HEAD PORTION BOTTOM PORTION | NO | NO | 1250~1050 | 2 | 1050~950 | 4 | NO |
| | HEAD PORTION BOTTOM PORTION | NO | NO | 1250~1050 | 12 | 1050~950 | 4 | NO |
| | HEAD PORTION BOTTOM PORTION | NO | NO | 1250~1050 | 6 | 1050~950 | 4 | NO |
| | HEAD PORTION BOTTOM PORTION | NO | NO | 1250~1050 | 2 | 1050~950 | 4 | NO |
| | HEAD PORTION BOTTOM PORTION | NO | NO | 1250~1050 | 2 | 1050~950 | 4 | NO |
| | HEAD PORTION BOTTOM PORTION | NO | NO | 1250~1050 | 7 | 1050~950 | 4 | NO |

| STEEL NO. | HEAT TREATMENT STARTING TEMPERA-TURE (° C.) | HEAT TREATMENT | MICRO STRUC-TURE | SVH (Hv, 98N) | Rmax (μm) | SVH/ Rmax | NCC (PIECES) | FLSR (MPa) | NOTE |
|---|---|---|---|---|---|---|---|---|---|
| A8 | — | NO | PEAR-LITE | 330 | 160 | 2.1 | 26 | 305 | |
| | | | PEAR-LITE | 325 | 155 | 2.1 | 24 | 305 | |

TABLE 3-1-continued

| | | | | | | | | |
|---|---|---|---|---|---|---|---|---|
| — | NO | PEAR-LITE | 330 | 120 | 2.8 | 22 | 315 | |
| | | PEAR-LITE | 325 | 115 | 2.8 | 23 | 315 | |
| — | NO | PEAR-LITE | 330 | 120 | 2.8 | 8 | 335 | |
| | | PEAR-LITE | 325 | 115 | 2.8 | 23 | 315 | |
| 800 | YES | PEAR-LITE | 395 | 160 | 2.5 | 24 | 320 | |
| | | PEAR-LITE | 384 | 155 | 2.5 | 23 | 315 | |
| 780 | YES | PEAR-LITE | 395 | 120 | 3.3 | 22 | 340 | |
| | | PEAR-LITE | 384 | 115 | 3.3 | 21 | 335 | |
| 780 | YES | PEAR-LITE | 395 | 120 | 3.3 | 7 | 360 | |
| | | PEAR-LITE | 384 | 115 | 3.3 | 7 | 355 | |
| 780 | YES | PEAR-LITE | 395 | 110 | 3.6 | 21 | 410 | |
| | | PEAR-LITE | 384 | 100 | 3.8 | 20 | 415 | |
| 780 | YES | PEAR-LITE | 395 | 95 | 4.2 | 15 | 425 | |
| | | PEAR-LITE | 384 | 90 | 4.3 | 17 | 425 | |
| 770 | YES | PEAR-LITE | 395 | 85 | 4.6 | 14 | 430 | |
| | | PEAR-LITE | 384 | 70 | 5.5 | 13 | 430 | |
| 750 | YES | PEAR-LITE | 395 | 50 | 7.9 | 12 | 440 | |
| | | PEAR-LITE | 384 | 50 | 7.7 | 11 | 445 | |
| 750 | YES | PEAR-LITE | 395 | 50 | 7.9 | 4 | 460 | |
| | | PEAR-LITE | 384 | 50 | 7.7 | 3 | 465 | |
| 750 | YES | PEAR-LITE | 395 | 45 | 8.8 | 13 | 450 | |
| | | PEAR-LITE | 384 | 45 | 8.5 | 12 | 450 | |
| 750 | YES | PEAR-LITE | 395 | 40 | 9.9 | 13 | 455 | |
| | | PEAR-LITE | 384 | 40 | 9.6 | 12 | 455 | |
| 750 | YES | PEAR-LITE | 395 | 35 | 11.3 | 11 | 460 | |
| | | PEAR-LITE | 384 | 30 | 12.8 | 11 | 465 | |
| 750 | YES | PEAR-LITE | 395 | 35 | 11.3 | 3 | 480 | |
| | | PEAR-LITE | 384 | 30 | 12.8 | 2 | 485 | |
| 700 | TEMPERATURE REDUCTION → NOT ALLOWED | PEAR-LITE | 300 | 25 | 12.0 | 11 | 230 | MANY DESCALING COUNTS |
| | | PEAR-LITE | 305 | 20 | 15.3 | 12 | 240 | |
| 820 | YES | PEAR-LITE | 395 | 190 | 2.1 | 28 | 270 | LOW DESCALING COUNTS |
| | | PEAR-LITE | 384 | 180 | 2.1 | 24 | 280 | |
| 700 | TEMPERATURE REDUCTION → NOT ALLOWED | PEAR-LITE | 300 | 50 | 6.0 | 12 | 215 | LOW DESCALING TEMPERATURE |
| | | PEAR-LITE | 305 | 50 | 6.1 | 13 | 220 | |
| 780 | YES | PEAR-LITE | 395 | 120 | 3.3 | 22 | 340 | LOW DESCALING COUNTS ON BOTTOM PORTION |
| 820 | | PEAR-LITE | 400 | 200 | 2.0 | 35 | 260 | |
| 820 | YES | PEAR-LITE | 400 | 195 | 2.1 | 25 | 255 | LOW DESCALING COUNTS ON HEAD PORTION |
| 770 | | PEAR-LITE | 384 | 120 | 3.2 | 20 | 345 | |

TABLE 3-2

| STEEL NO. | SITE | ATMOS-PHERE CONTROL OF HEATING FURNACE | ME-CHANICAL DESCALING | DESCALING DURING ROUGH ROLLING RIGHT AFTER RE-HEATING EXTRACTION TEMPERA-TURE (° C.) | COUNT (TIMES) | DESCALING DURING FINISH ROLLING TEMPERA-TURE (° C.) | COUNT (TIMES) | HIGH-PRESSURE WATER, AIR, AND MECHANICAL DESCALING CONTROL |
|---|---|---|---|---|---|---|---|---|
| A17 | HEAD PORTION | NO | NO | 1250~1050 | 6 | 1050~950 | 3 | NO |
| | BOTTOM PORTION | | | | | | | |
| | HEAD PORTION | NO | NO | 1250~1050 | 6 | 1050~950 | 4 | NO |
| | BOTTOM PORTION | | | | | | | |
| | HEAD PORTION | NO | NO | 1250~1050 | 6 | 1050~950 | 4 | YES |
| | BOTTOM PORTION | | | | | | | |
| | HEAD PORTION | NO | NO | 1250~1050 | 6 | 1050~950 | 3 | NO |
| | BOTTOM PORTION | | | | | | | |
| | HEAD PORTION | NO | NO | 1250~1050 | 6 | 1050~950 | 4 | NO |
| | BOTTOM PORTION | | | | | | | |
| | HEAD PORTION | NO | NO | 1250~1050 | 6 | 1050~950 | 4 | YES |
| | BOTTOM PORTION | | | | | | | |
| | HEAD PORTION | NO | YES (IRON PIECE GRID) | 1250~1050 | 6 | 1050~950 | 4 | NO |
| | BOTTOM PORTION | | | | | | | |
| | HEAD PORTION | YES (NITROGEN 80%) | NO | 1250~1050 | 6 | 1050~950 | 4 | NO |
| | BOTTOM PORTION | | | | | | | |
| | HEAD PORTION | NO | NO | 1250~1050 | 6 | 1050~950 | 5 | NO |
| | BOTTOM PORTION | | | | | | | |
| | HEAD PORTION | NO | NO | 1250~1050 | 6 | 1050~950 | 5 | YES |
| | BOTTOM PORTION | | | | | | | |
| | HEAD PORTION | NO | NO | 1250~1050 | 6 | 1050~950 | 8 | NO |
| | BOTTOM PORTION | | | | | | | |
| | HEAD PORTION | NO | YES (HARD BALL) | 1250~1050 | 6 | 1050~950 | 8 | NO |
| | BOTTOM PORTION | | | | | | | |
| | HEAD PORTION | YES (NITROGEN 80%) | NO | 1250~1050 | 6 | 1050~950 | 8 | NO |
| | BOTTOM PORTION | | | | | | | |
| | HEAD PORTION | YES (NITROGEN 80%) | NO | 1250~1050 | 6 | 1050~950 | 8 | NO |
| | BOTTOM PORTION | | | | | | | |
| | HEAD PORTION | YES (NITROGEN 80%) | YES (IRON PIECE GRID) | 1250~1050 | 6 | 1050~950 | 8 | YES |
| | BOTTOM PORTION | | | | | | | |
| | HEAD PORTION | NO | NO | 1250~1050 | 6 | 1050~950 | 10 | NO |
| | BOTTOM PORTION | | | | | | | |
| | HEAD PORTION | NO | NO | 1250~1050 | 6 | 1050~950 | 1 | NO |
| | BOTTOM PORTION | | | | | | | |
| | HEAD PORTION | NO | NO | 1250~1050 | 6 | 1050~950 | 8 | NO |
| | BOTTOM | | | | | | | |

TABLE 3-2-continued

| | | | | | | | | |
|---|---|---|---|---|---|---|---|---|
| | PORTION | | | | | | | |
| | HEAD PORTION | NO | NO | 1250~1050 | 6 | 1050~950 | 3 | NO |
| | BOTTOM PORTION | NO | NO | 1250~1050 | 6 | 1050~950 | 1 | NO |
| | HEAD PORTION | NO | NO | 1250~1050 | 6 | 1050~950 | 1 | NO |
| | BOTTOM PORTION | NO | NO | 1250~1050 | 6 | 1050~950 | 3 | NO |

| STEEL NO. | HEAT TREATMENT STARTING TEMPERA-TURE (° C.) | HEAT TREATMENT | MICRO STRUC-TURE | SVH (Hv, 98N) | Rmax (μm) | SVH/ Rmax | NCC (PIECES) | FLSR (MPa) | NOTE |
|---|---|---|---|---|---|---|---|---|---|
| A17 | — | NO | PEAR-LITE | 350 | 140 | 2.5 | 23 | 310 | |
| | | | PEAR-LITE | 345 | 135 | 2.6 | 21 | 310 | |
| | — | NO | PEAR-LITE | 350 | 125 | 2.8 | 21 | 320 | |
| | | | PEAR-LITE | 355 | 125 | 2.8 | 20 | 320 | |
| | — | NO | PEAR-LITE | 350 | 125 | 2.8 | 8 | 340 | |
| | | | PEAR-LITE | 355 | 125 | 2.8 | 9 | 340 | |
| | 800 | YES | PEAR-LITE | 430 | 140 | 3.1 | 23 | 330 | |
| | | | PEAR-LITE | 420 | 135 | 3.1 | 22 | 335 | |
| | 780 | YES | PEAR-LITE | 430 | 125 | 3.4 | 21 | 345 | |
| | | | PEAR-LITE | 420 | 125 | 3.4 | 19 | 350 | |
| | 780 | YES | PEAR-LITE | 430 | 125 | 3.4 | 20 | 365 | |
| | | | PEAR-LITE | 420 | 125 | 3.4 | 18 | 375 | |
| | 780 | YES | PEAR-LITE | 430 | 110 | 3.9 | 17 | 420 | |
| | | | PEAR-LITE | 420 | 105 | 4.0 | 16 | 420 | |
| | 780 | YES | PEAR-LITE | 430 | 100 | 4.3 | 15 | 425 | |
| | | | PEAR-LITE | 420 | 90 | 4.7 | 16 | 435 | |
| | 770 | YES | PEAR-LITE | 430 | 100 | 4.3 | 15 | 425 | |
| | | | PEAR-LITE | 420 | 105 | 4.0 | 16 | 420 | |
| | 770 | YES | PEAR-LITE | 430 | 100 | 4.3 | 6 | 445 | |
| | | | PEAR-LITE | 420 | 105 | 4.0 | 7 | 450 | |
| | 750 | YES | PEAR-LITE | 430 | 80 | 5.4 | 14 | 425 | |
| | | | PEAR-LITE | 420 | 75 | 5.6 | 13 | 430 | |
| | 750 | YES | PEAR-LITE | 430 | 60 | 7.2 | 12 | 455 | |
| | | | PEAR-LITE | 420 | 70 | 6.0 | 13 | 460 | |
| | 750 | YES | PEAR-LITE | 430 | 50 | 8.6 | 11 | 470 | |
| | | | PEAR-LITE | 420 | 60 | 7.0 | 12 | 460 | |
| | 750 | YES | PEAR-LITE | 430 | 50 | 8.6 | 4 | 490 | |
| | | | PEAR-LITE | 420 | 60 | 7.0 | 5 | 475 | |
| | 750 | YES | PEAR-LITE | 430 | 30 | 14.3 | 11 | 480 | |
| | | | PEAR-LITE | 420 | 40 | 10.5 | 13 | 470 | |

TABLE 3-2-continued

| | | | | | | | | |
|---|---|---|---|---|---|---|---|---|
| 720 | TEMPERATURE REDUCTION → NOT ALLOWED | PEAR-LITE | 310 | 30 | 10.3 | 12 | 250 | MANY DESCALING COUNTS |
| | | PEAR-LITE | 300 | 30 | 10.0 | 13 | 245 | |
| 820 | YES | PEAR-LITE | 430 | 195 | 2.2 | 28 | 280 | LOW DESCALING COUNTS |
| | | PEAR-LITE | 420 | 200 | 2.1 | 34 | 275 | |
| 720 | TEMPERATURE REDUCTION → NOT ALLOWED | PEAR-LITE | 310 | 80 | 3.9 | 13 | 220 | LOW DESCALING TEMPERA-TURE |
| | | PEAR-LITE | 300 | 75 | 4.0 | 14 | 225 | |
| 780 | YES | PEAR-LITE | 430 | 140 | 3.1 | 21 | 350 | LOW DESCALING COUNTS ON BOTTOM PORTION |
| 820 | | PEAR-LITE | 420 | 200 | 2.1 | 35 | 275 | |
| 780 | YES | PEAR-LITE | 430 | 210 | 2.0 | 31 | 260 | LOW DESCALING COUNTS ON UPPER PORTION |
| 820 | | PEAR-LITE | 420 | 135 | 3.1 | 24 | 350 | |

In addition, Tables 3-1 and 3-2 show manufacturing conditions using steel rails A8, A13 shown in Tables 1-1 and characteristics of rails. Tables 3-1 and 3-2 show atmosphere control of the heating furnace during hot rolling, mechanical descaling, temperature ranges or number of descaling using high-pressure water or air during rough hot rolling immediately after the extraction of the re-heated bloom and during finish hot rolling, control of high-pressure water or air and mechanical descaling, heat treatment starting temperature, heat treatment, microstructures of the surfaces of the head portion and the bottom portion of the rail, surface hardness (SVH), the maximum surface roughness (Rmax), surface hardness (SVH)/the maximum surface roughness (Rmax), the number of concavities and convexities that exceed 0.30 times the maximum surface roughness (NCC), and values of fatigue limit stress range (FLSR). Moreover, the results of the fatigue tests performed by the methods shown in FIGS. 6A and 6B are included.

In addition, various test conditions are as follows.

<Fatigue Test>

Rail shape: 136 pounds of a steel rail (67 kg/m) is used.

Fatigue test (see FIGS. 6A and 6B)

Test method: a test of three-point bending (span length of 1 m and a frequency of 5 Hz) is performed on an actual steel rail.

Load condition: stress range control (maximum-minimum, the minimum load is 10% of the maximum load) is performed.

Test posture (see FIGS. 6A and 6B)

Test of the surface of the head portion: loading on the bottom portion (exert tensile strength on the head portion)

Test of the surface of the bottom portion: exert load on the head portion (exert tensile strength on the bottom portion)

Number of repetition: 200 million times, the maximum stress range in case of non-facture is referred to as a fatigue limit stress range.

(1) Rails of Examples (65 pieces)

The steel rails A1 to A65 are rails of which the chemical component values, the microstructures of the surfaces of the head portion and the bottom portion, the surface hardness (SVH), and the value of the maximum surface roughness (Rmax) are in the ranges of the Examples.

The steel rails A9, A27, A50, A58, and A65 are rails of which, in addition to the chemical component values, the microstructures of the surfaces of the head portion and the bottom portion of the rail, the surface hardness (SVH), and the maximum surface roughness (Rmax), the number of concavities and convexities that exceed 0.30 times the maximum surface roughness is less than or equal to 10 in the most suitable conditions of the Examples.

The steel rails A10, A11, A14, A15, A17, A19, A21, A23, A25, A28, A32, A34, A38, A40, A42, A45, A48, A51, A56, A59, and A61 are rails of which the value of the surface hardness (SVH)/the maximum surface roughness (Rmax), as well as the chemical component values, the microstructures of the surfaces of the head portion and the bottom portion of the rail, the surface hardness (SVH), and the maximum surface roughness (Rmax) are in the ranges of the Examples.

The steel rails A12, A18, A35, A52, and A62 are rails of which the value of the surface hardness (SVH)/the maximum surface roughness (Rmax), as well as the chemical component values, the microstructures of the surfaces of the head portion and the bottom portion of the rail, the surface hardness (SVH), and the maximum surface roughness Rmax are in the ranges of the Examples, and the number of concavities (NCC) and convexities that exceed 0.30 times the maximum surface roughness is less than or equal to 10 in the most suitable conditions of the Examples.

The rails shown in Tables 1-1 to 1-4 of which the values of the surface hardness SVH/the maximum surface roughness Rmax is greater than or equal to 3.5 were selectively subject to (A) the atmosphere control of the heating furnace, (B) the mechanical descaling, and (C) the descaling using high-pressure water or air during hot rolling.

In particular, by increasing the number of the descaling, the descaling using high-pressure water or air was performed 8 to 12 times at a rough hot rolling temperature of 1,250 to 1,050° C. and 5 to 8 times at a finish hot rolling temperature of 1,050 to 950° C. Thereafter, accelerated cooling after hot rolling as described in Patent Documents 3 and 4 or the like was performed as needed.

(2) Comparative Rails (20 pieces)

The steel rails a1 to a6 are rails of which the chemical components are not in the ranges of the invention.

The steel rails a7 to a20 are rails of which the surface hardness (SVH) of the surfaces of the head portion and the bottom portion of the rail and the value of the maximum surface roughness (Rmax) are not in the ranges of the invention.

As shown in Tables 1-1, 1-2, 2-1, and 2-2, in the steel rails a1 to a6, chemical components C, Si, and Mn in steel are not in the ranges of the invention, so that ferrite structures, pro-eutectoid cementite structures, and martensite structures are generated. That is, since C contained in the steel rails A1 to A65 of Examples is in the range of 0.65 to 1.20%, Si is in the range of 0.05 to 2.00%, and Mn is in the range of 0.05 to 2.00%, as compared with the steel rails a1to a6, the ferrite structures, pro-eutectoid cementite structures, and martensite structures which have adverse effects on the fatigue damage resistance are not generated. Therefore, the surfaces of the head portion and the bottom portion of the steel rail can be stably provided with the pearlite structure in predetermined hardness ranges. Accordingly, it becomes possible to ensure the fatigue strength (the fatigue limit stress range is equal to or higher than 300 MPa) needed for the steel rails and thus improve the fatigue damage resistance of the rail.

In addition, as shown in Tables 1-1 to 1-4, 2-1, and 2-2, the surface hardness SVH of the head portion and the bottom portion and the maximum surface roughness Rmax of the steel rails a7 to a20 are not in the ranges of the invention, the fatigue strength (greater than or equal to 300 MPa of the fatigue limit stress range) needed for the rail cannot be ensured. That is, in the steel rails A1 to A65 of the Examples, the surface hardness of the head portion and the bottom portion is in the range of Hv320 to Hv500, and the maximum surface roughness Rmax is less than or equal to 180 μm, the fatigue strength (greater than or equal to 300 MPa of the fatigue limit stress range) needed for the rail is ensured. As a result, it becomes possible to improve of the fatigue damage resistance of the rail.

Figure 7:
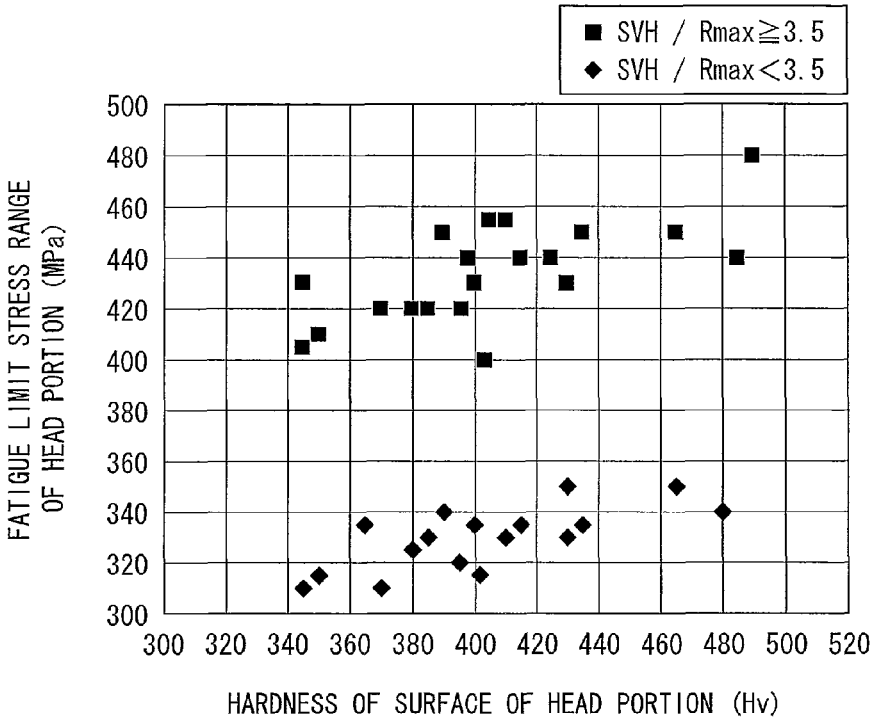
FIG. 7 is a graph showing a relationship between the surface hardness of the head portion and the fatigue limit stress range to be distinguished by the ratio of the surface roughness SVH to the maximum surface roughness Rmax of the pearlite rail.

FIG. 7 shows the relationships between the surface hardness of the head portion and the fatigue limit stress range of the steel rails (the steel rails A8, A10 to A11, A13 to A17, A19 to A26, A28, A31 to A34, A37 to A42, A44 to A45, A47 to A49, A51, A55 to A57, A59 to A61, and A64 shown in Tables 1-1 to 1-2) of Examples to be distinguished by the values of the surface hardness (SVH)/the maximum surface roughness (Rmax).

Figure 8:
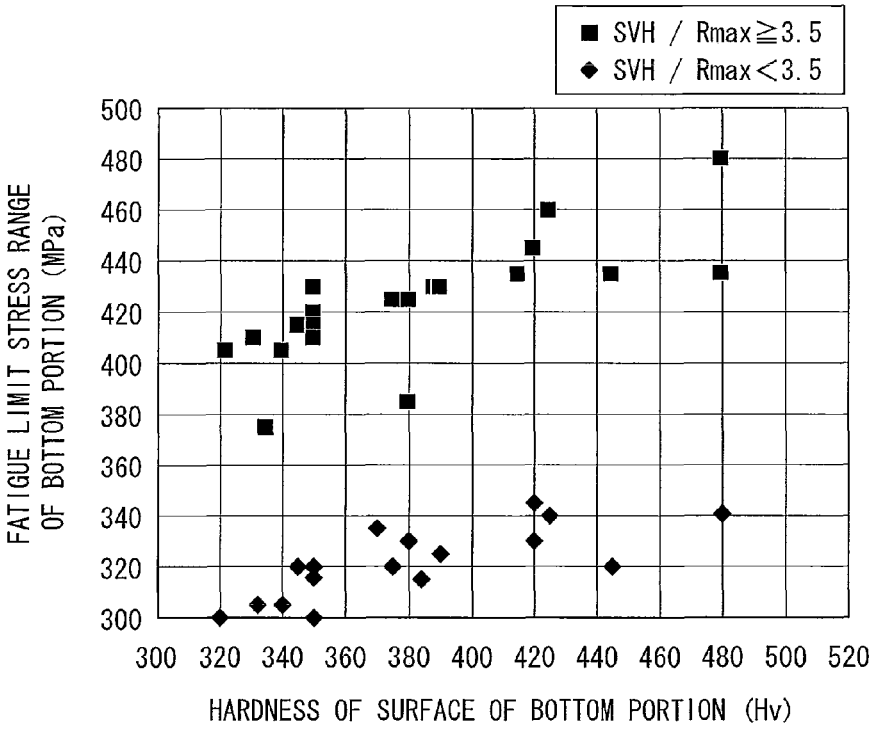
FIG. 8 is a graph showing a relationship between the surface hardness of the bottom portion and the fatigue limit stress range to be distinguished by the ratio of the surface roughness SVH to the maximum surface roughness Rmax of the pearlite rail.

FIG. 8 shows the relationships between the surface hardness of the bottom portion and the fatigue limit stress range of the steel rails (the steel rails A8, A10 to A11, A13 to A17, A19 to A26, A28, A31 to A34, A37 to A42, A44 to A45, A47 to A49, A51, A55 to A57, A59 to A61, and A64 shown in Tables 1-1 to 1-4) of the Examples to be distinguished by the values of the surface hardness SVH/the maximum surface roughness Rmax.

As shown in FIGS. 7 and 8, since the values of the surface hardness (SVH)/the maximum surface roughness (Rmax) of the steel rails of Examples are confined in the predetermined ranges, the fatigue strength (fatigue limit stress range) of the rail exhibiting the pearlite structure can further be improved. As a result, the fatigue damage resistance is significantly increased.

Figure 9:
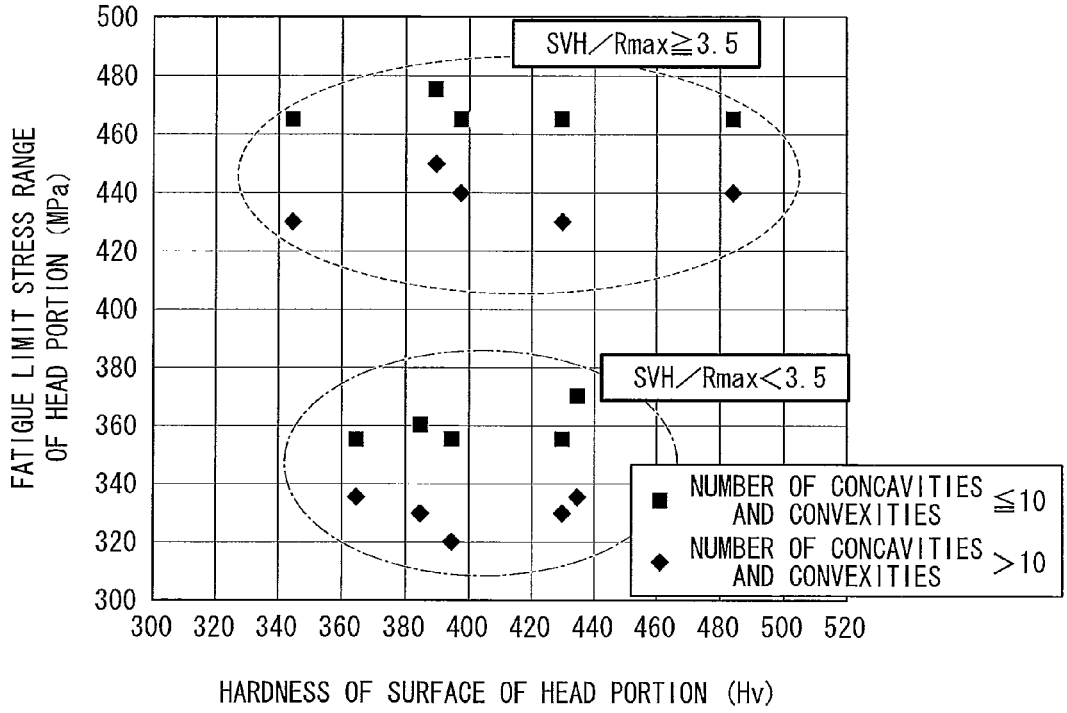
FIG. 9 is a graph showing relationships between the surface hardness of the head portion of the pearlite-base rail and the fatigue limit stress range to be distinguished by the number of concavities and convexities that exceed 0.30 times the maximum surface roughness.

In addition, FIG. 9 shows the relationships between the surface hardness of the head portion and the fatigue limit stress range of the steel rails (the steel rails A8 to A9, A11 to A12, A11 to A18, A26 to A27, A34 to A35, A49 to A50, A51 to A52, A57 to A58,A61 to A62, and A64 to A65 shown in Tables 1-1 to 1-4) of the Examples to be distinguished by the number of concavities and convexities that exceed 0.30 times the maximum surface roughness.

Figure 10:
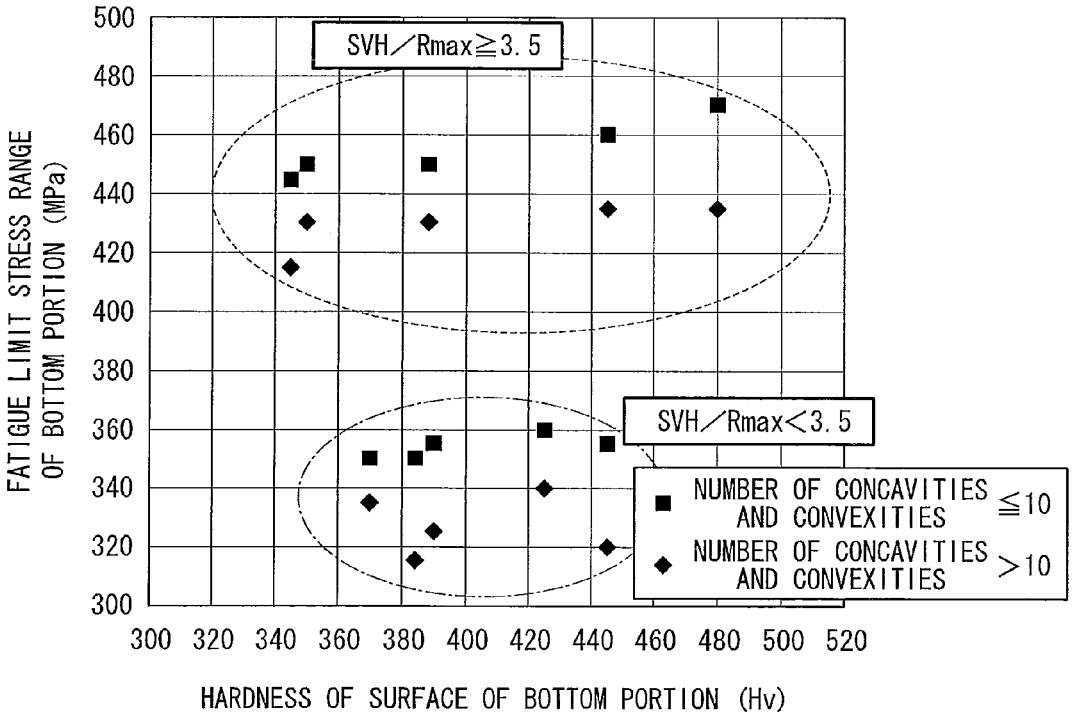
FIG. 10 is a graph showing relationships between the surface hardness of the bottom portion of the pearlite-base rail and the fatigue limit stress range to be distinguished by the number of concavities and convexities that exceed 0.30 times the maximum surface roughness.

FIG. 10 shows the relationships between the surface hardness of the head portion and the fatigue limit stress range of the steel rails (the steel rails A8 to A9, A11 to A12, A17 to A18, A26 to A27, A34 to A35, A49 to A50, A51 to A52, A57 to A58, A61 to A62, and A64 to A65 shown in Tables 1-1 to 1-4) of the Examples to be distinguished by the number of concavities and convexities that exceed 0.30 times the maximum surface roughness.

As shown in FIGS. 9 and 10, in the steel rails of the Examples, since the number of concavities and convexities that exceed 0.30 times the maximum surface roughness is confined in the predetermined range, the fatigue strength (fatigue limit stress range) of the rail exhibiting the pearlite structure can further be improved. As a result, the fatigue damage resistance can further be improved.

In addition, as shown in Tables 3-1 and 3-2, the atmosphere control, the mechanical descaling, and the descaling using high-pressure water or air are performed under predetermined conditions. In addition, heat treatment is appropriately performed as needed to ensure the surface hardness of the head portion and the bottom portion and reduce the maximum surface roughness (Rmax), thereby confining the value of the surface hardness (SVH)/the maximum surface roughness (Rmax) and the number of concavities and convexities that exceed 0.30 times the maximum surface roughness to be in the predetermined ranges. Thus, the fatigue strength (fatigue limit stress range) of the rail exhibiting the pearlite structure can further be improved. As a result, the fatigue damage resistance can further be improved.

REFERENCE SIGNS LIST

1 head top portion
2 head corner portion
3 sole portion
10 pearlite-based rail
11 head portion
12 bottom portion
1S surface of head top portion
3S surface of sole portion
R1 region of 5 mm from 1S
R3 region of 5 mm from 3S
1A boundary between head top and corner portion

The invention claimed is:

1. A pearlite rail comprising:
by mass %,
0.65 to 1.20% of C;
0.05 to 2.00% of Si;
0.05 to 2.00% of Mn; and
the balance composed of Fe and inevitable impurities,
wherein at least part of a head portion and at least part of a bottom portion have a pearlite structure, and
a surface hardness of a portion of the pearlite structure is in a range of Hv320 to Hv500 and a maximum surface roughness of a portion of the pearlite structure is less than or equal to 180 μm and wherein a ratio of the surface hardness to the maximum surface roughness is greater than or equal to 3.5.

2. The pearlite rail according to claim 1, wherein, in the portion of which the maximum surface roughness is measured,
the number of concavities and convexities that exceed 0.30 times the maximum surface roughness with respect to an average value of roughnesses in a rail vertical direction from the bottom portion to the head portion is less than or equal to 40 per length of 5 mm in a rail longitudinal direction of surfaces of the head portion and the bottom portion.

3. The pearlite rail according to claim 1, wherein the pearlite rail further contains, by mass %, one or two kinds of 0.01 to 2.00% of Cr and 0.01 to 0.50% of Mo.

4. The pearlite rail according to claim 1, wherein the pearlite rail further contains, by mass %, one or two kinds of 0.005 to 0.50% of V and 0.002 to 0.050% of Nb.

5. The pearlite rail according to claim 1, wherein the pearlite rail further contains, by mass %, 0.01 to 1.00% of Co.

6. The pearlite rail according to claim 1, wherein the pearlite rail further contains, by mass %, 0.0001 to 0.0050% of B.

7. The pearlite rail according to claim 1, wherein the pearlite rail further contains, by mass %, 0.01 to 1.00% of Cu.

8. The pearlite rail according to claim 1, wherein the pearlite rail further contains, by mass %, 0.01 to 1.00% of Ni.

9. The pearlite rail according to claim 1, wherein the pearlite rail further contains, by mass %, 0.0050 to 0.0500% of Ti.

10. The pearlite rail according to claim 1, wherein the pearlite rail further contains, by mass %, one or two kinds of 0.0005 to 0.0200% of Mg and 0.0005 to 0.0200% of Ca.

11. The pearlite rail according to claim 1, wherein the pearlite rail contains, by mass %, 0.0001 to 0.2000% of Zr.

12. The pearlite rail according to claim 1, wherein the pearlite rail further contains, by mass %, 0.0040 to 1.00% of Al.

13. The pearlite rail according to claim 1, wherein the pearlite rail further contains, by mass %, 0.0060 to 0.0200% of N.

14. The pearlite rail according to claim 1, wherein the pearlite rail further contains, by mass %:

one or two kinds of 0.01 to 2.00% of Cr and 0.01 to 0.50% of Mo;

one or two kinds of 0.005 to 0.50% of V and 0.002 to 0.050% of Nb;

0.01 to 1.00% of Co;

0.0001 to 0.0050% of B;

0.01 to 1.00% of Cu;

0.01 to 1.00% of Ni;

0.0050 to 0.0500% of Ti;

0.0005 to 0.0200% of Mg and 0.0005 to 0.0200% of Ca;

0.0001 to 0.2000% of Zr;

0.0040 to 1.00% of Al; and 0.0060 to 0.0200% of N.

* * * * *